US010566126B2

(12) United States Patent
Shimoichi

(10) Patent No.: US 10,566,126 B2
(45) Date of Patent: Feb. 18, 2020

(54) CHIP INDUCTOR AND MANUFACTURING METHOD THEREOF

(71) Applicant: ROHM CO., LTD., Kyoto (JP)

(72) Inventor: Takuma Shimoichi, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/703,091

(22) Filed: Sep. 13, 2017

(65) Prior Publication Data

US 2018/0082775 A1 Mar. 22, 2018

(30) Foreign Application Priority Data

Sep. 16, 2016 (JP) ..... 2016-182094

(51) Int. Cl.

| | |
|---|---|
| ***H01F 5/00*** | (2006.01) |
| ***H01F 17/00*** | (2006.01) |
| ***H01F 27/29*** | (2006.01) |
| ***H01F 27/32*** | (2006.01) |
| ***H01F 41/04*** | (2006.01) |
| ***H01F 41/12*** | (2006.01) |

(52) U.S. Cl.

CPC ..... *H01F 17/0013* (2013.01); *H01F 27/292* (2013.01); *H01F 27/327* (2013.01); *H01F 41/041* (2013.01); *H01F 41/122* (2013.01); *H01F 41/127* (2013.01)

(58) Field of Classification Search

USPC ..... 336/200

See application file for complete search history.

(56) References Cited

U.S. PATENT DOCUMENTS

| | | | | |
|---|---|---|---|---|
| 6,787,442 | B2 * | 9/2004 | Hayashida | H01L 23/49816 257/E21.508 |
| 8,325,003 | B2 * | 12/2012 | Wu | H01F 17/0013 333/181 |
| 9,704,640 | B2 * | 7/2017 | Choi | H01F 27/292 |
| 2013/0278374 | A1 * | 10/2013 | Thorslund | H01F 27/2804 336/200 |
| 2014/0184377 | A1 * | 7/2014 | Kim | H01F 17/0006 336/200 |
| 2016/0104563 | A1 * | 4/2016 | Jeong | H01F 17/0013 336/192 |

FOREIGN PATENT DOCUMENTS

| | | |
|---|---|---|
| JP | H09-199365 A | 7/1997 |

* cited by examiner

*Primary Examiner* — Ronald Hinson

(57) ABSTRACT

A chip inductor includes a substrate having a main surface, an insulating layer covering the main surface of the substrate, an external terminal formed on the insulating layer, and a coil conductor of a spiral-shape routed to a region outside the external terminal and a region facing the external terminal at the main surface of the substrate.

19 Claims, 25 Drawing Sheets

CHIP INDUCTOR AND MANUFACTURING METHOD THEREOF

BACKGROUND OF THE INVENTION

1. Field of the Invention

The present invention relates to a chip inductor and a manufacturing method thereof.

2. Description of the Related Art

JPH09-199365 discloses an inductor including a plurality of terminal electrodes, and a spiral-shaped conductor pattern formed only in a region between the plurality of terminal electrodes.

SUMMARY OF THE INVENTION

One preferred embodiment of the present invention provides a chip inductor including a substrate having a main surface, an insulating layer covering the main surface of the substrate, an external terminal formed on the insulating layer, and a coil conductor of a spiral-shape routed to a region outside the external terminal and a region facing the external terminal at the main surface of the substrate.

One preferred embodiment of the present invention provides a chip inductor including a substrate having a main surface, an insulating layer covering the main surface of the substrate, a first external terminal and a second external terminal formed on the insulating layer at intervals each other, and a coil conductor of a spiral-shape routed to a region between the first external terminal and the second external terminal, a first region facing the first external terminal and a second region facing the second external terminal at the main surface of the substrate.

One preferred embodiment of the present invention provides a manufacturing method of a chip inductor including the steps of preparing a substrate having a main surface, forming a coil conductor of a spiral-shape at the main surface of the substrate, forming an insulating layer so as to cover the coil conductor on the main surface of the substrate, forming a first opening exposing an inner end portion of the coil conductor in the insulating layer, forming a second opening exposing an outer end portion of the coil conductor in the insulating layer, forming a first external terminal to be connected to the inner end portion of the coil conductor by embedding a conductive material into the first opening, and forming a second external terminal to be connected to the outer end portion of the coil conductor by embedding a conductive material into the second opening.

The aforementioned or other objects, features, and effects of the present invention will be clarified by the following description of preferred embodiments given below with reference to the accompanying drawings.

DETAILED DESCRIPTION OF THE PREFERRED EMBODIMENTS

Figure 1:
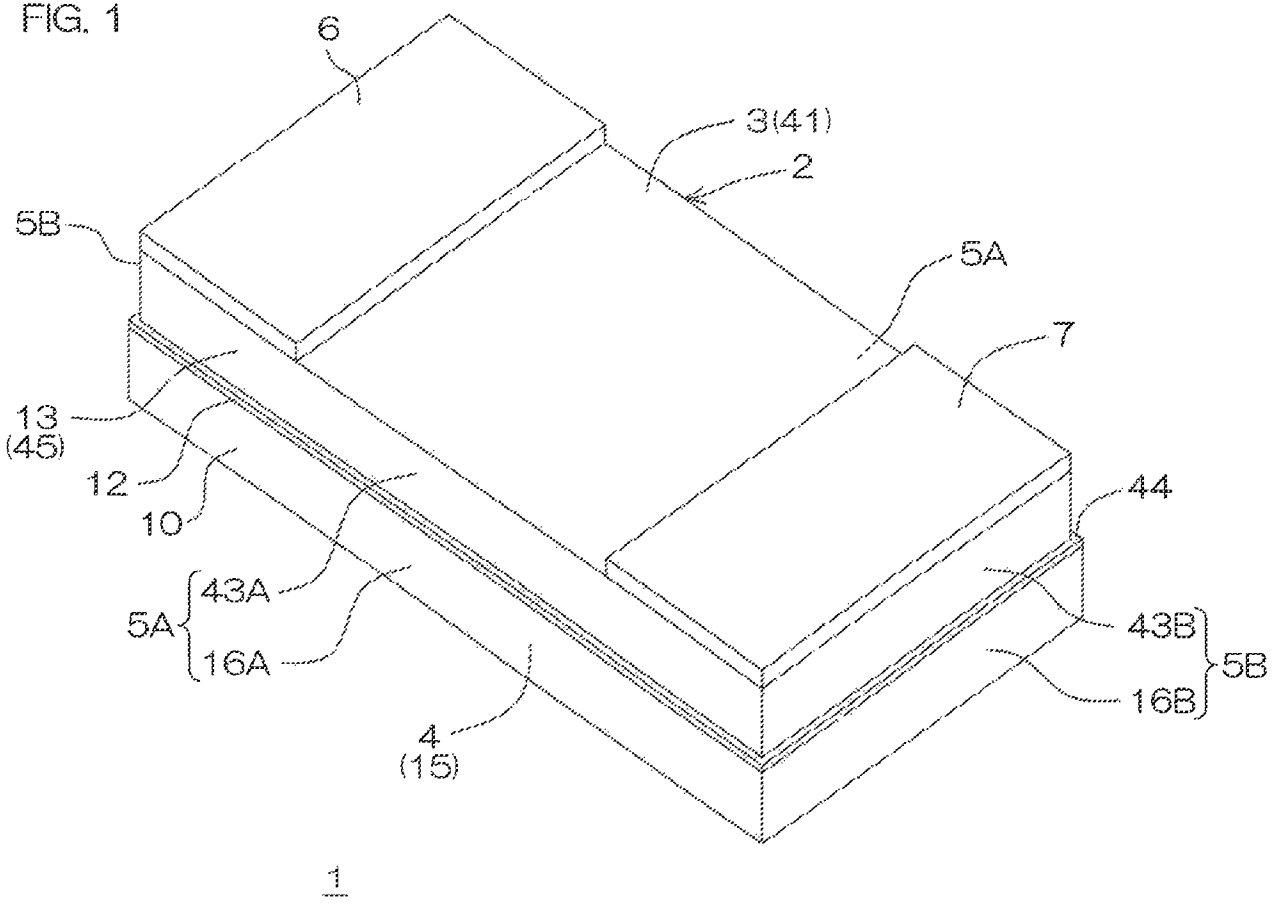
FIG. 1 is a perspective view of a chip inductor according to a first preferred embodiment of the present invention.

A Quality Factor (a Q-value) is known as one of parameter representing characteristic of an inductor. The Q-value of the inductor is represented by "$Q=2\pi fL/R$". "f" is a frequency of a current flowing in the coil conductor. "L" is an inductance component of the coil conductor. "R" is a resistance component of the coil conductor.

A high Q-value indicates that the inductor is close to an ideal inductor. The Q-value increases due to the increase of "L" and/or the reduction of "R".

According to the conventional inductor disclosed in JPH09-199365, a forming region of the coil conductor is restricted to a region only between the plurality of external terminals. Because of that, in conventional inductor, it is difficult to increase "L" and to decrease "R". That is, the conventional inductor has a structure where the Q-value can be hardly improved.

Therefore, one preferred embodiment of the present invention provides a chip inductor capable of improving the Q-value and a method of manufacturing thereof.

One preferred embodiment of the present invention provides a chip inductor including a substrate having a main surface, an insulating layer covering the main surface of the substrate, an external terminal formed on the insulating layer, and a coil conductor of a spiral-shape routed to a region outside the external terminal and a region facing the external terminal at the main surface of the substrate.

According to the chip inductor, the coil conductor of the spiral-shape is routed to the region outside the external terminal and the region facing the external terminal at the main surface of the substrate. A planar area of the coil conductor can thus be increased. Therefore, a resistance component of the coil conductor can be reduced.

Also, according to the chip inductor, a formation region of the coil conductor can be extended to the region facing the external terminal from the region outside the external terminal. A number of windings of the coil conductor can thus be increased. Therefore, the inductor component of the coil conductor can be increased.

Furthermore, according to the chip inductor, the insulating layer is interposed in a region between the coil conductor and the external terminal. A formation of a parasitic capacitance in a region between the coil conductor and the external terminal can thereby be suppressed. A fluctuation of the Q-value due to the parasitic capacitance can thus be suppressed. Therefore, the chip inductor capable of appropriately improving the Q-value can be provided.

One preferred embodiment of the present invention provides a chip inductor including a substrate having a main surface, an insulating layer covering the main surface of the substrate, a first external terminal and a second external terminal formed on the insulating layer at intervals each other, and a coil conductor of a spiral-shape routed to a region between the first external terminal and the second external terminal, a first region facing the first external terminal and a second region facing the second external terminal at the main surface of the substrate.

According to the chip inductor, the coil conductor of the spiral-shape is routed to the region between the first external terminal and the second external terminal, the first facing region facing the first external terminal and the second facing region facing the second external terminal at the main surface of the substrate. A planar area of the coil conductor can thus be increased. Therefore, a resistance component of the coil conductor can be reduced.

Also, according to the chip inductor, a formation region of the coil conductor can be extended to the first facing region facing the first external terminal and the second facing region facing the second external terminal. A number of windings of the coil conductor can thus be increased. Therefore, the inductor component of the coil conductor can be increased.

Furthermore, according to the chip inductor, the insulating layer is interposed in a region between the coil conductor and the first external terminal and in a region between the coil conductor and the second external terminal. A formation of a parasitic capacitance in the region between the coil conductor and the first external terminal and in the region between the coil conductor and the second external terminal can thereby be suppressed. A fluctuation of the Q-value due to the parasitic capacitance can thus be suppressed. Therefore, the chip inductor capable of appropriately improving the Q-value can be provided.

One preferred embodiment of the present invention provides a manufacturing method of a chip inductor including the steps of preparing a substrate having a main surface, forming a coil conductor of a spiral-shape at the main surface of the substrate, forming an insulating layer so as to cover the coil conductor on the main surface of the substrate, forming a first opening exposing an inner end portion of the coil conductor in the insulating layer, forming a second opening exposing an outer end portion of the coil conductor in the insulating layer, forming a first external terminal to be connected to the inner end portion of the coil conductor by embedding a conductive material into the first opening, and forming a second external terminal to be connected to the outer end portion of the coil conductor by embedding a conductive material into the second opening.

According to the manufacturing method, the chip inductor having a structure in which the coil conductor of the spiral-shape is formed at the main surface of the substrate can be manufactured. The coil conductor of the spiral-shape is routed to a region between the first external terminal and the second external terminal, a first facing region facing the first external terminal and a second facing region facing the second external terminal. According to the chip inductor, a planar area of the coil conductor can be increased. Therefore, a resistance component of the coil conductor can be reduced.

Also, according to the chip inductor, a formation region of the coil conductor can be extended to the first facing region facing the first external terminal and the second facing region facing the second external terminal. A number of windings of the coil conductor can thus be increased. Therefore, the inductor component of the coil conductor can be increased.

Furthermore, according to the chip inductor, the insulating layer is interposed in a region between the coil conductor and the first external terminal and in a region between the coil conductor and the second external terminal. A formation of a parasitic capacitance in the region between the coil conductor and the first external terminal and in the region between the coil conductor and the second external terminal can thereby be suppressed. A fluctuation of the Q-value due to the parasitic capacitance can thus be suppressed. Therefore, the chip inductor capable of appropriately improving the Q-value can be manufactured and provided.

Hereinafter, preferred embodiments of the present invention will be described in detail with reference to the accompanying drawings.

Figure 2:
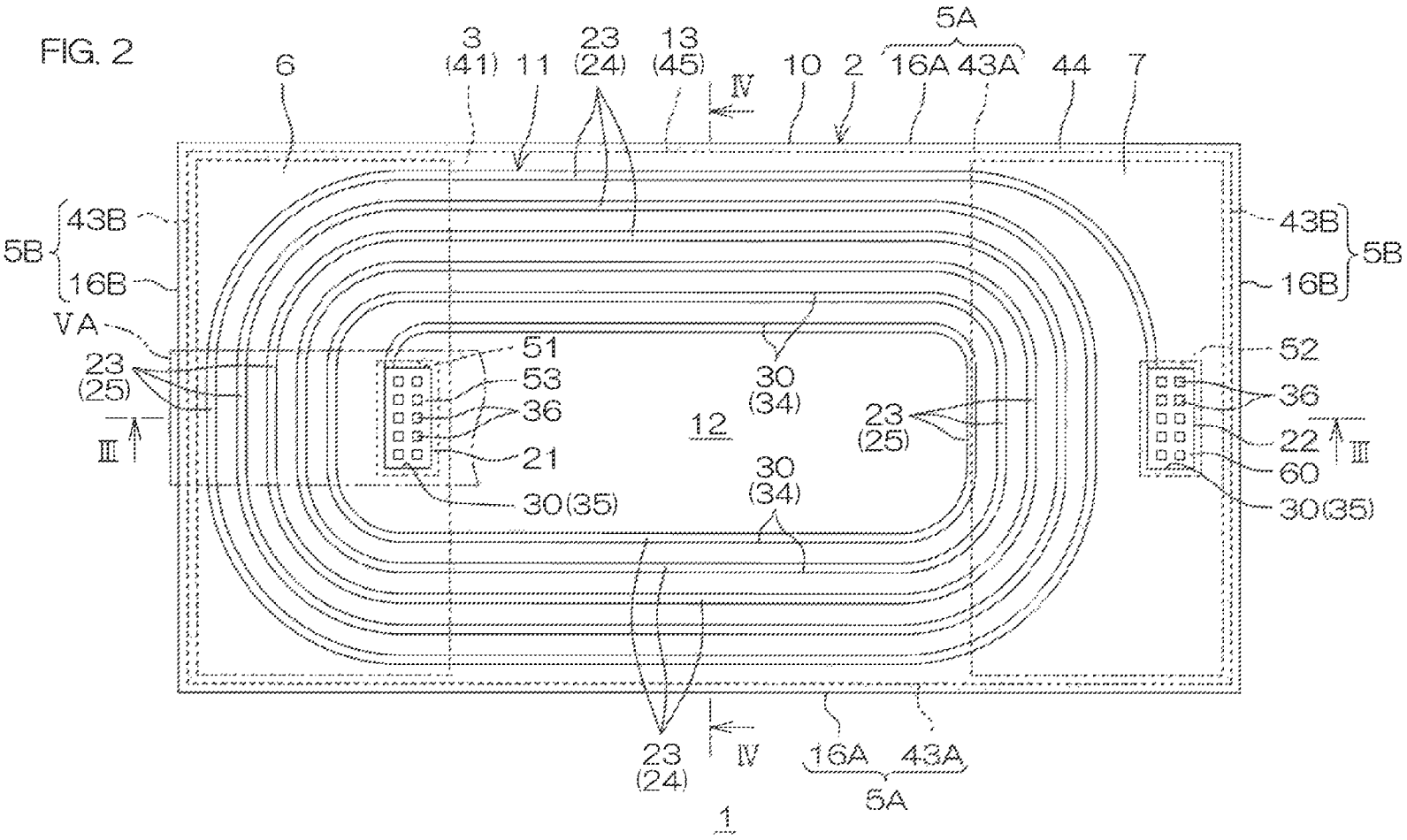
FIG. 2 is a plan view showing an internal structure of the chip inductor shown in FIG. 1.
Figure 3:
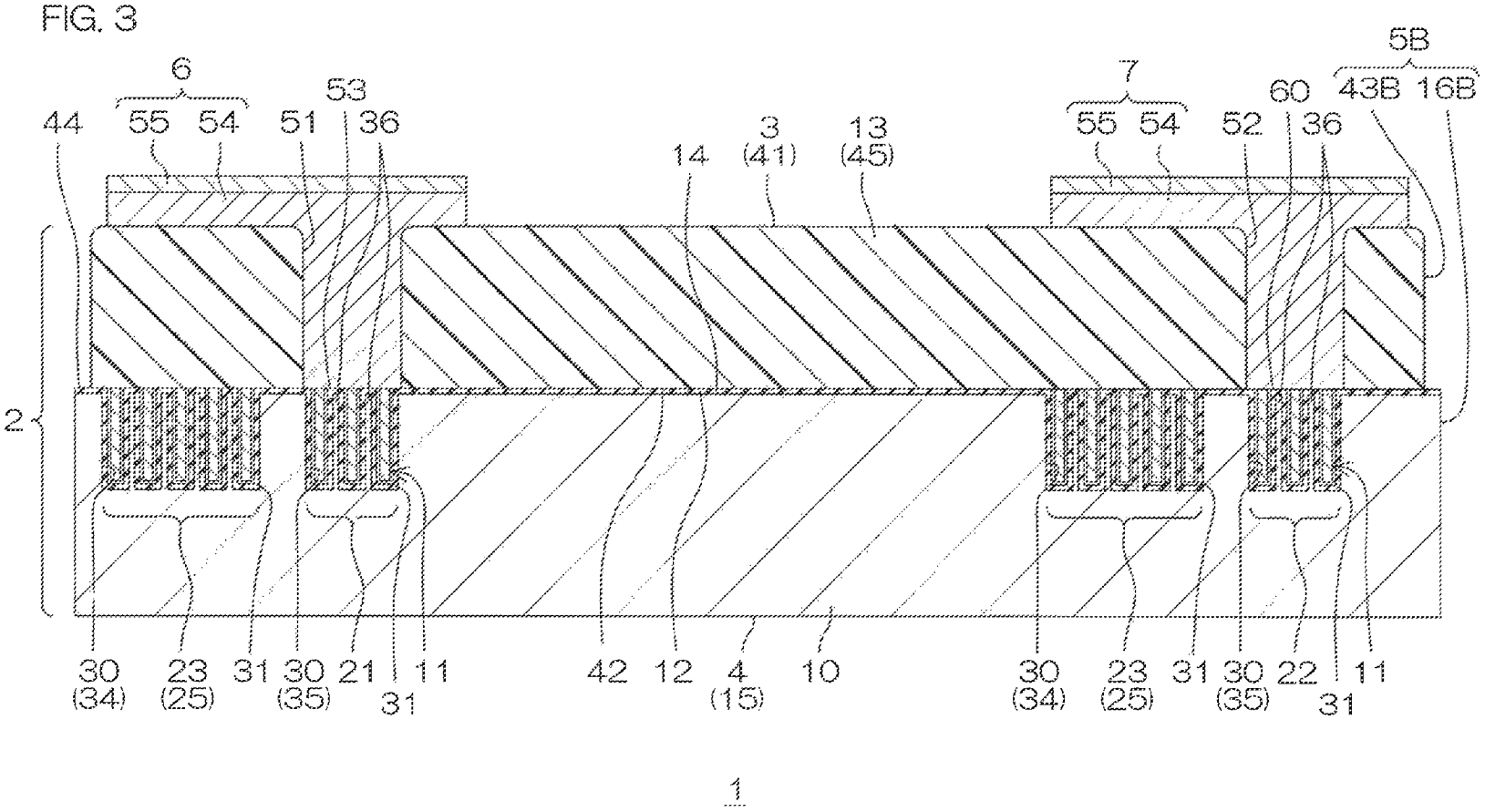
FIG. 3 is a sectional view taken along line III-III shown in FIG. 2.
Figure 4:
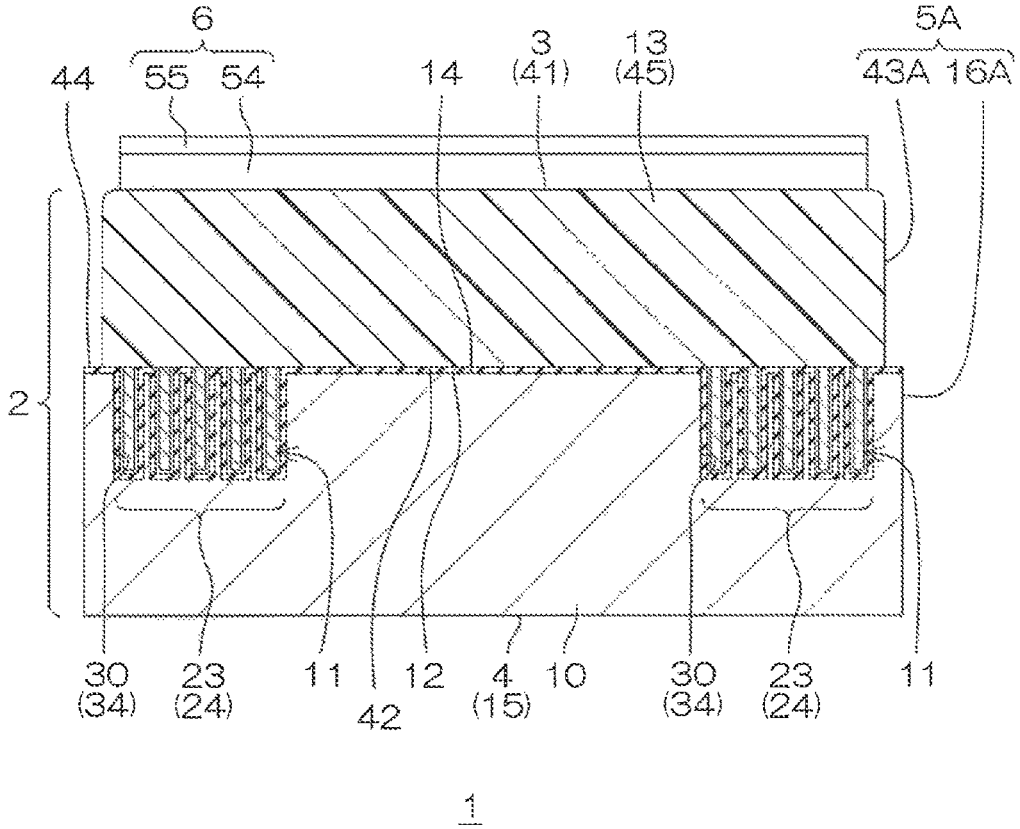
FIG. 4 is a sectional view taken along line IV-IV shown in FIG. 2.

FIG. 1 is a perspective view of a chip inductor 1 according to a first preferred embodiment of the present invention. FIG. 2 is a plan view showing an internal structure of the chip inductor 1 shown in FIG. 1. FIG. 3 is a sectional view taken along line III-III shown in FIG. 2. FIG. 4 is a sectional view taken along line IV-IV shown in FIG. 2.

The chip inductor 1 is an electronic device that is a chip part type called 0603 (0.6 mm×0.3 mm) chip, 0402 (0.4 mm×0.2 mm) chip, 03015 (0.3 mm×0.15 mm) chip or the like.

Referring to FIG. 1, the chip inductor 1 includes a chip body 2 formed in a rectangular parallelepiped shape. The chip body 2 includes a first main surface 3 on one side, a second main surface 4 on the other side, and lateral surfaces 5A, 5B connecting the first main surface 3 and the second main surface 4.

The first main surface 3 and the second main surface 4 of the chip body 2 are formed in a rectangular shape in plan view as viewed from a normal directions thereof (hereinafter simply referred to as "the plan view"). The lateral surfaces 5A, 5B of the chip body 2 include a pair of the longitudinal lateral surfaces 5A extending along a longitudinal direction of the chip body 2 and a pair of the transverse lateral surfaces 5B extending along a transverse direction of the chip body 2.

"0603", "0402", "03015", etc., described above are defined by a length of the longitudinal lateral surfaces 5A and a length of the transverse lateral surfaces 5B. A thickness of the chip body 2 may be equal to or greater than 90 μm and equal to or smaller than 350 μm (e.g. approximately 140 μm).

A first external terminal 6 and a second external terminal 7 are formed on the first main surface 3 of the chip body 2 at intervals each other.

The first external terminal 6 is formed at one end portion side (the end portion at left side of FIG. 1) in the longitudinal direction of the chip body 2. The first external terminal 6 is formed in a rectangular shape extending along the transverse direction.

The second external terminal 7 is formed at the other end portion side (the end portion at right side of FIG. 1) in the longitudinal direction of the chip body 2. The second external terminal 7 is formed in a rectangular shape extending along the transverse direction.

Referring to FIG. 1 and FIG. 2, the chip body 2 includes a substrate 10, a coil conductor 11, a surface insulating film 12 and an insulating layer 13.

The first main surface 3 of the chip body 2 is formed by the insulating layer 13. The second main surface 4 of the chip body 2 is formed by the substrate 10. The lateral surfaces 5A, 5B of the chip body 2 are formed by the substrate 10, the surface insulating film 12 and the insulating layer 13. The first external terminal 6 and the second external terminal 7 are arranged on the insulating layer 13 at intervals each other.

The substrate 10 is formed in a rectangular parallelepiped shape. The substrate 10 includes a first main surface 14 on one side, a second main surface 15 on the other side, and lateral surfaces 16A, 16B connecting the first main surface 14 and the second main surface 15. The first main surface 14 of the substrate 10 is covered with the surface insulating film 12.

The second main surface 15 of the substrate 10 forms the second main surface 4 of the chip body 2. The lateral surfaces 16A, 16B of the substrate 10 forms the lateral surfaces 5A, 5B of the chip body 2 respectively.

The substrate 10 may be a high resistance substrate having a resistivity of equal to or greater than 0.5 MΩ·cm and equal to or smaller than 1.5 MΩ·cm (e.g. approximately 1.0 MΩ·cm). A thickness of the substrate 10 is equal to or greater than 80 um and equal to or smaller than 250 um (e.g. approximately 100 um).

Referring to FIG. 2, the coil conductor 11 is formed at the first main surface 14 of the substrate 10. The coil conductor 11 is formed in a spiral-shape in the plan view. The coil conductor 11 is routed to a region between the first external terminal 6 and the second external terminal 7, a first facing region facing the first external terminal 6 and a second facing region facing the second external terminal 7 at the first main surface 14 of the substrate 10.

The coil conductor 11 includes an inner end portion 21, an outer end portion 22 and a spiral portion 23.

The inner end portion 21 is formed in the first facing region facing the first external terminal 6 at the first main surface 14 of the substrate 10. The inner end portion 21 is formed directly below the first external terminal 6. The outer end portion 22 is formed in the second facing region facing the second external terminal 7 at the first main surface 14 of the substrate 10. The outer end portion 22 is formed directly below the second external terminal 7.

The spiral portion 23 is spirally routed to a region between the inner end portion 21 and the outer end portion 22. The spiral portion 23 is spirally routed to the region between the first external terminal 6 and the second external terminal 7, the first facing region facing the first external terminal 6, and the second facing region facing the second external terminal 7, at the first main surface 14 of the substrate 10.

The spiral portion 23 includes a first region 24 and a second region 25. The first region 24 of the spiral portion 23 is formed in the region between the first external terminal 6 and the second external terminal 7. The second region 25 of the spiral portion 23 is formed at the first facing region facing the first external terminal 6 and the second facing region facing the second external terminal 7 respectively.

The first region 24 of the spiral portion 23 extends along a facing direction where the first external terminal 6 and the second external terminal 7 face each other. The facing direction is also the longitudinal direction of the substrate 10. The second region 25 of the spiral portion 23 extends along a cross direction that intersects the facing direction. The cross direction is also an orthogonal direction that is orthogonal to the facing direction. The cross direction is also the transverse direction of the substrate 10.

The coil conductor 11 is embedded in a trench 30 formed at the first main surface 14 of the substrate 10 in this embodiment. The trench 30 is formed in a spiral-shape in the plan view. The trench 30 is formed by digging the first main surface 14 of the substrate 10 toward the second main surface 15 of the substrate 10.

Referring to FIG. 3 and FIG. 4, the trench 30 has an elongated rectangular cross-sectional shape extending along a thickness direction of the substrate 10 regarding to a cross sectional view as viewed from a direction orthogonal to a spiral direction of the coil conductor 11. The trench 30 may have a tapered cross-sectional shape where a width of a bottom part is smaller than an opening width.

An inner wall insulating film 31 is formed on an inner wall surface of the trench 30. The inner wall surface of the trench 30 includes a side wall and a bottom wall. The inner wall insulating film 31 is formed in a film-like along the inner wall surface of the trench 30. More specifically, one surface (i.e. the surface of the trench 30 side) and the other surface of the inner wall insulating film 31 are formed along the inner wall surface of the trench 30.

The inner wall insulating film 31 is communicated with the surface insulating film 12 outside the trench 30. A thickness of the inner wall insulating film 31 is substantially equal to a thickness of the surface insulating film 12.

The coil conductor 11 is embedded in the trench 30 via the inner wall insulating film 31. That is, the inner wall insulating film 31 is interposed in a region between the coil conductor 11 and the inner wall surface of the trench 30.

Figure 5A:
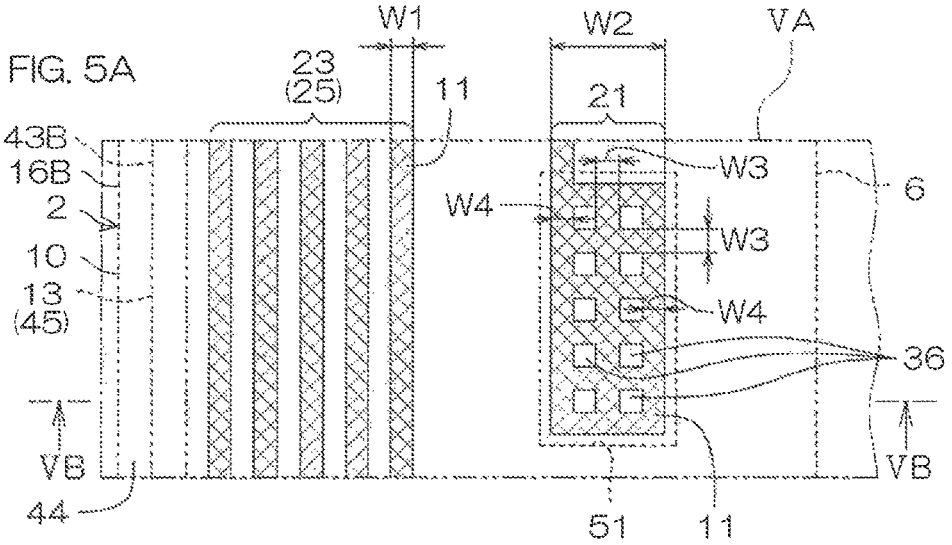
FIG. 5A is an enlarged view of region VA shown in FIG. 2.
Figure 5B:
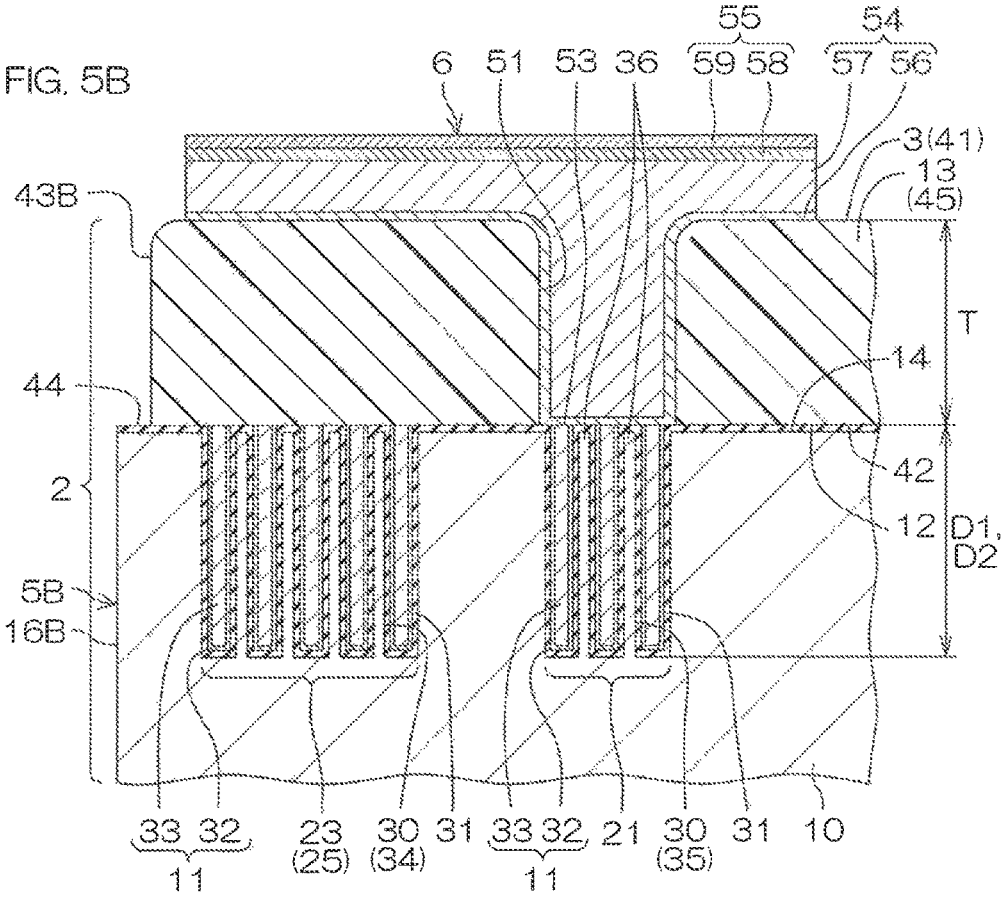
FIG. 5B is a cross-sectional view taken along line VB-VB shown in FIG. 5A.

FIG. 5A is an enlarged view of region VA shown in FIG. 2. FIG. 5B is a cross-sectional view taken along line VB-VB shown in FIG. 5A. Only a structure of the inner end portion 21 side of the coil conductor 11 is shown in FIG. 5A and FIG. 5B.

The trench 30 includes a spiral trench 34 for the spiral portion 23 and an end trench 35 for the inner end portion 21. Although not shown in FIG. 5A and FIG. 5B, the trench 30 includes an end trench 35 for the outer end portion 22 as well, as shown in FIG. 1 to FIG. 4.

The structure of the end trench 35 for the outer end portion 22 is substantially equal to the structure of the end trench 35 for the inner end portion 21. In FIG. 1 to FIG. 4, the same reference numerals are applied to structures corresponding to structures of the end trench 35 for the inner end portion 21 in the end trench 35 for the outer end portion 22, and descriptions thereof will be omitted.

The end trench 35 is formed in a rectangular shape extending along the transverse direction of the substrate 10 in the plan view. The end trench 35 has an opening width W2 larger than an opening width W1 of the spiral trench 34. A depth D1 of the spiral trench 34 is substantially equal to a depth D2 of the end trench 35 (D2≈D1 or D2=D1).

An aspect ratio D1/W1 is larger than an aspect ratio D2/W2 (D1/W1>D2/W2). The aspect ratio D1/W1 is defined by a ratio of the depth D1 of the spiral trench 34 with respect to the opening width W1 of the spiral trench 34. The aspect ratio D2/W2 is defined by a ratio of the depth D2 of the end trench 35 with respect to the opening width W2 of the end trench 35.

Referring to FIG. 5B, the end trench 35 includes a pillar portion 36 as an example of a columnar portion. In this embodiment, the end trench 35 includes a plurality (e.g. 10 pieces) of pillar portions 36.

The plurality of pillar portions 36 is formed in a matrix pattern (a matrix pattern of 5 rows and 2 columns) at intervals along the longitudinal direction and the transverse direction of the substrate 10. The plurality of pillar portions 36 is formed in an inner region of the end trench at intervals from the side wall of the end trench 35.

Each of pillar portions 36 is formed by a part of the substrate 10 so as to be erected upwardly from the bottom wall of the end trench 35 towards the first main surface 14 side of the substrate 10. The end trench 35 is formed in a lattice shape in the plan view by the plurality of pillar portions 36.

A width W3 between adjacent pillar portions 36 is preferably substantially equal to the opening width W1 of the spiral trench 34 (W3≈W1 or W3=W1). A width W4 between a side wall of the end trench 35 and the pillar portion 36 is preferably substantially equal to the opening width W1 of the spiral trench 34 (W4≈W1 or W4=W1).

The coil conductor 11 covers a side wall of each the pillar portion 36 in the end trench 35. More specifically, the coil conductor 11 covers the side wall of each the pillar portion 36 via the inner wall insulating film 31.

Each of the pillar portions 36 may be formed in a quadrangular column shape. Each of the pillar portions 36 may be formed in a polygonal column shape other than the quadrangular column shape, such as a triangular column shape, a hexagonal column shape, etc. Each of the pillar portions 36 may be formed in a column shape (i.e. a cylindrical shape) or an elliptic column shape.

At least one of the pillar portions 36 may be integrally formed in the side wall of the end trench 35. At least two of the pillar portions 36 may be integrally formed each other. The end trench 35 free from the pillar portion 36 may be adopted.

Referring to FIG. 2, the outer end portion 22 has a shape substantially equal to a shape of the inner end portion 21. However, the outer end portion 22 may have a different shape from a shape of the inner end portion 21. That is, the end trench 35 for the outer end portion 22 may have a different shape from a shape of the end trench 35 for the inner end portion 21.

The coil conductor 11 is embedded in the trench 30 having such a structure. Regarding to the spiral direction, a width of the inner end portion 21 is greater than a width of the spiral portion 23 in the coil conductor 11.

The inner end portion 21 is formed in a rectangular shape extending along the transverse direction of the substrate 10. The structure of the outer end portion 22 is substantially equal to the structure of the inner end portion 21. The descriptions about the structure of the outer end portion 22 side will be omitted.

Referring to FIG. 5B, the coil conductor 11 has a laminated structure including a first conductive layer 32 and a second conductive layer 33 laminated in this order from the inner wall surface side of the trench 30. The first conductive layer 32 is formed in a film-like along the inner wall surface of the trench 30.

More specifically, one surface (i.e. the surface of the trench 30 side) and the other surface of the first conductive layer 32 are formed along the inner wall surface of the trench 30. The first conductive layer 32 defines a recessed space inside the trench 30.

The first conductive layer 32 may have a single layer structure consisting of a titanium nitride layer or a titanium layer. The first conductive layer 32 has a laminated structure including a titanium nitride layer and a titanium layer laminated in this order from the inner wall surface side of the trench 30. The first conductive layer 32 is formed as a barrier electrode layer by including a titanium nitride layer and/or a titanium layer.

The second conductive layer 33 is embedded in the recessed space defined by the first conductive layer 32. The second conductive layer 33 includes a metal material containing copper as a main component. The second conductive layer 33 occupies the most part of the coil conductor 11. The resistance component of the coil conductor 11 can thus be reduced.

"a metal material containing copper as a main component" means a metal material having the highest mass ratio (mass %) of copper among constituent materials of said metal material (hereinafter the same). The metal material containing copper as a main component includes at least one of high purity copper, aluminum-copper alloy (Al—Cu alloy) or aluminum-silicon-copper alloy (Al—Si—Cu alloy).

High purity copper may contain trace impurities, but includes copper having a purity of equal to or greater than 99.9999% (6N), equal to or greater than copper having a purity of 99.99% (4N), or the like.

In a case where the second conductive layer 33 is made of Al—Cu alloy, a mass ratio $R_{Cu}$ of copper is higher than a mass ratio $R_{Al}$ of aluminum ($R_{Cu}>R_{Al}$). In a case where the second conductive layer 33 is made of Al—Si—Cu alloy, a mass ratio $R_{Cu}$ of copper is higher than a mass ratio $R_{Al}$ of aluminum and a mass ratio $R_{Si}$ of silicon ($R_{Cu}>R_{Al}$ and $R_{Cu}>R_{Si}$).

A thickness of the first conductive layer 32 may be equal to or smaller than 1/100 of a thickness of the second conductive layer 33. The thickness of the first conductive layer 32 may be equal to or greater than 1000 Å and equal to or smaller than 2000 Å (e.g. approximately 1500 Å).

The second conductive layer 33 may contain tungsten instead of the metal material containing copper as a main component. According to the second conductive layer containing tungsten, the coil conductor 11 can be appropriately embedded in the trench 30.

Referring to FIG. 3 and FIG. 4, the insulating layer 13 is formed on the surface insulating film 12 so as to cover the coil conductor 11. The insulating layer 13 covers a substantially whole region of the surface insulating film 12.

The insulating layer 13 includes a first main surface 41 on one side, a second main surface 42 on the other side, and lateral surfaces 43A, 43B connecting the first main surface 41 and the second main surface 42.

The first main surface 41 of the insulating layer 13 forms the first main surface 3 of the chip body 2. The second main surface 42 of the insulating layer 13 is in contact with the coil conductor 11 and the surface insulating film 12. The lateral surfaces 43A, 43B of the insulating layer 13 form the lateral surfaces 5A, 5B of the chip body 2 respectively.

The lateral surfaces 43A, 43B of the insulating layer 13 is formed at intervals from the lateral surfaces 16A, 16B of the substrate 10 to an inner side of the substrate 10. A step portion 44 connecting the lateral surfaces 16A, 16B of the substrate 10 and the lateral surfaces 43A, 43B of the insulating layer 13 is formed in a region there between. The step portion 44 is formed by a peripheral portion of the substrate 10. More specifically, the step portion 44 is formed by the peripheral portion covered by the surface insulating film 12 in the substrate 10.

The insulating layer 13 has a single layer structure consisting of a resin layer 45. The resin layer 45 may include a photosensitive resin. The photosensitive resin may include a photoresist of negative type. The photoresist may include an epoxy resin. The resin layer 45 may be referred to as a permanent layer or a permanent film.

The insulating layer 13 suppresses a parasitic capacitance formed in a region between the first external terminal 6 and the coil conductor 11, and, a parasitic capacitance formed in a region between the second external terminal 7 and the coil conductor 11. The insulating layer 13 protects the substrate 10, the coil conductor 11, etc. Referring to FIG. 5B, a thickness T of the insulating layer 13 is equal to or greater than 10 μm and equal to or smaller than 100 μm (e.g. approximately 40 μm).

Referring to FIG. 3 and FIG. 4, a first pad opening 51 and a second pad opening 52 are formed in the insulating layer 13.

The first pad opening 51 penetrates the insulating layer 13. The first pad opening 51 exposes the inner end portion 21 as a first pad region 53. The first pad opening 51 exposes substantially a whole region of the inner end portion 21.

An opening edge of the first pad opening 51 is formed in a convex curve shape towards inside the first pad opening 51. The opening edge of the first pad opening 51 is formed by a portion connecting an inner wall of the first pad opening 51 and the first main surface 41 of the insulating layer 13. The first external terminal 6 can be appropriately embedded into the first pad opening 51 by the first pad opening 51 having the opening edge formed in the convex curve shape.

The second pad opening 52 penetrates the insulating layer 13. The second pad opening 52 exposes the outer end portion 22 as a second pad region 60. The second pad opening 52 exposes substantially a whole region of the outer end portion 22.

An opening edge of the second pad opening 52 is formed in a convex curve shape towards inside the second pad opening 52. The opening edge of the second pad opening 52 is formed by a portion connecting an inner wall of the second pad opening 52 and the first main surface 41 of the insulating layer 13. The second external terminal 7 can be appropriately embedded into the second pad opening 52 by the second pad opening 52 having the opening edge formed in the convex curve shape.

Referring to FIG. 2 and FIG. 5A, the first external terminal 6 is embedded in the first pad opening 51. The first external terminal 6 is entered into the first pad opening 51 from on the first main surface 41 of the insulating layer 13. The first external terminal 6 is connected to the inner end portion 21 inside the first pad opening 51.

The first external terminal 6 has a laminated structure including a first conductive layer 54 and a second conductive layer 55 laminated in this order from the inner end portion 21 side. A side wall of the first conductive layer 54 and a side wall of the second conductive layer 55 are formed in a flush outside the first pad opening 51.

The first conductive layer 54 has a laminated structure including a first lower metal layer 56 and a first upper metal layer 57 laminated in this order from the inner end portion 21 side.

The first lower metal layer 56 is formed in a film-like along the inner wall of the first pad opening 51 from the first main surface 41 of the insulating layer 13. More specifically, one surface (a surface of the inner wall side of the first wall opening 51) and the other surface of the first lower metal layer 56 are formed along the inner wall of the first pad opening 51.

The first lower metal layer 56 may have a single layer structure consisting of a titanium layer or a titanium layer. The first lower metal layer 56 may have a laminated structure including a titanium nitride layer and a titanium layer laminated in this order from the inner end portion 21 side. The first lower metal layer 56 is formed as a barrier seed layer by including the titanium layer and/or the titanium layer.

The first upper metal layer 57 is a plating layer formed on the first lower metal layer 56. The first upper metal layer 57 includes a metal material containing copper as a main component. The first upper metal layer 57 is formed along a surface of the first lower metal layer 56. The first upper metal layer 57 is embedded in a recessed space defined by the first lower metal layer 56.

The second conductive layer 55 of the first external terminal 6 has the laminated structure including a second lower metal layer 58 and a second upper metal layer 59 laminated in this order from the first conductive layer 54 side.

The second lower metal layer 58 includes a nickel-phosphorus alloy. The second lower metal layer 58 covers an outer surface of the first conductive layer 54 (the first upper metal layer 57). The second upper metal layer 59 includes gold. The second upper metal layer 59 covers an outer surface of the second lower metal layer 58.

The second external terminal 7 is embedded in the second pad opening 52. The second external terminal 7 is entered into the second pad opening 52 from on the first main surface 41 of the insulating layer 13. The second external terminal 7 is connected to the outer end portion 22 inside the second pad opening 52.

The second external terminal 7 has a laminated structure including the first conductive layer 54 and the second conductive layer 55 laminated in this order from the outer end portion 22 side, likewise the first external terminal 6. The structure of the second external terminal 7 is substantially equal to the structure of the first external terminal 6. In FIG. 1 to FIG. 4, the same reference numerals are applied to the structures corresponding to the structures of the first external terminal 6 in the second external terminal 7, and the descriptions thereof will be omitted.

FIG. 6A to FIG. 6M are cross sectional views for explaining an example of a manufacturing method of the chip inductor 1 of FIG. 1.

Figure 6A:
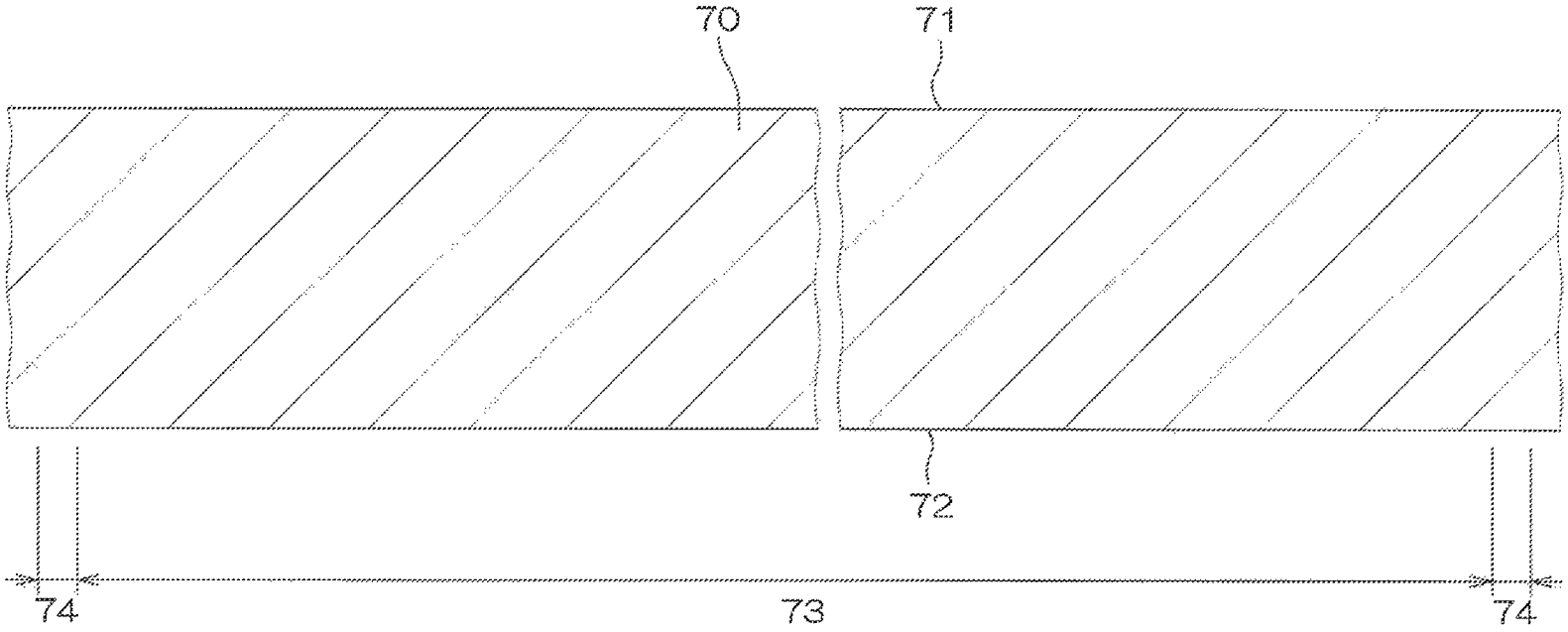
FIG. 6A to FIG. 6M are cross-sectional views for explaining an example of a manufacturing method of the chip inductor shown in FIG. 1.

Referring to FIG. 6A, first, the wafer 70 is prepared. A plurality of chip inductors 1 is cut out from the wafer 70. In FIG. 6A, a region where one chip inductor 1 is to be formed and a peripheral region thereof are shown only (hereinafter the same in FIG. 6B to FIG. 6M).

The wafer 70 includes a first main surface 71 and a second main surface 72. The first main surface 71 of the wafer 70 corresponds to the first main surface 14 of the substrate 10. The second main surface 72 of the wafer 70 corresponds to the second main surface 15 of the substrate 10. A thickness of the wafer 70 may be set to equal to or greater than 700 μm and equal to or smaller than 750 μm.

A plurality of chip forming regions 73 is set to the wafer 70. The plurality of chip forming regions 73 corresponds to the chip inductor 1, respectively, and is a region in which the coil conductor 11, etc., are formed. The plurality of chip forming regions 73 is defined by a boundary region 74 set in a region therebetween.

Figure 6B:
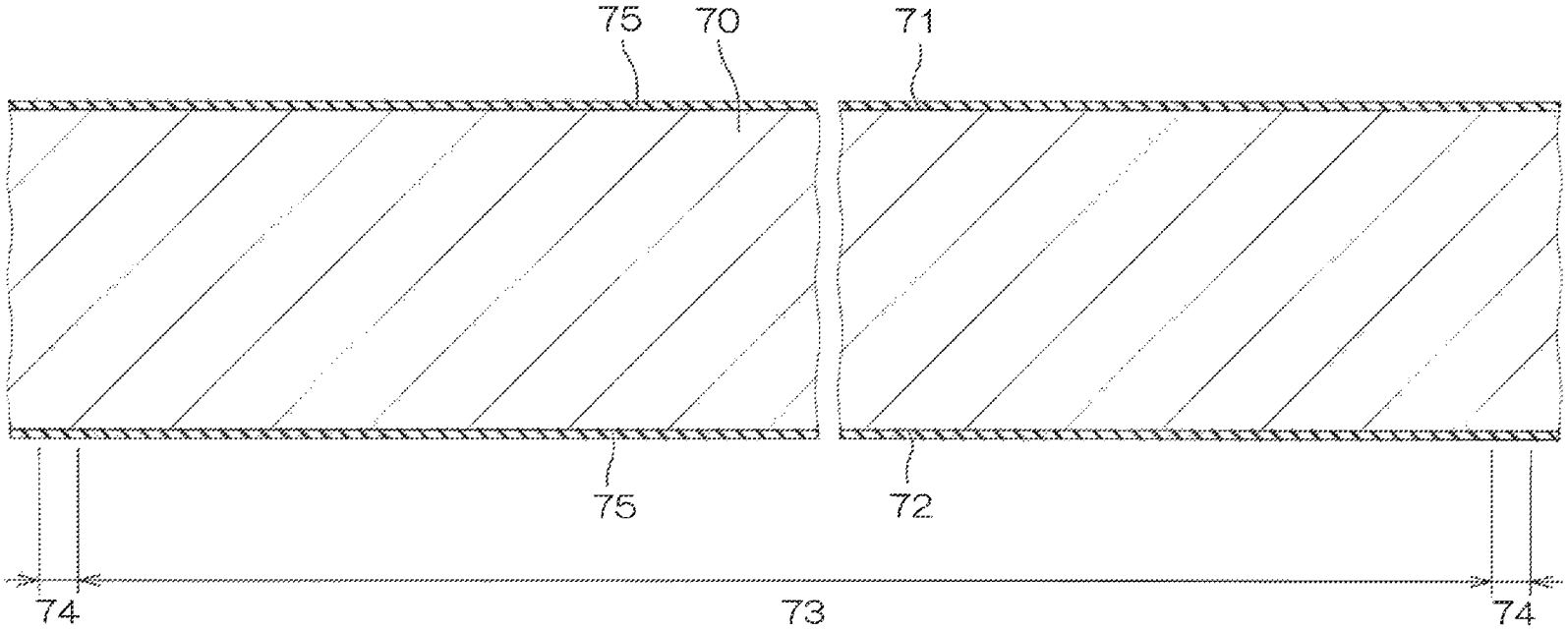

Next, referring to FIG. 6B, an insulating film 75 is formed on the first main surface 71 and the second main surface 72 of the wafer 70. The insulating film 75 may be a silicon oxide film. The insulating film 75 may be formed by a Chemical Vapor Deposition method (CVD method). The insulating film 75 may be formed by a thermal oxidation treatment.

A thickness of the insulating film 75 formed on the first main surface 71 is substantially equal to a thickness of the insulating film 75 formed on the second main surface 72. Thereby, a stress generated at the first main surface 71 side and a stress generated at the second main surface 72 side become substantially equal. The warping of the wafer 70 can thus be suppressed.

Figure 6C:
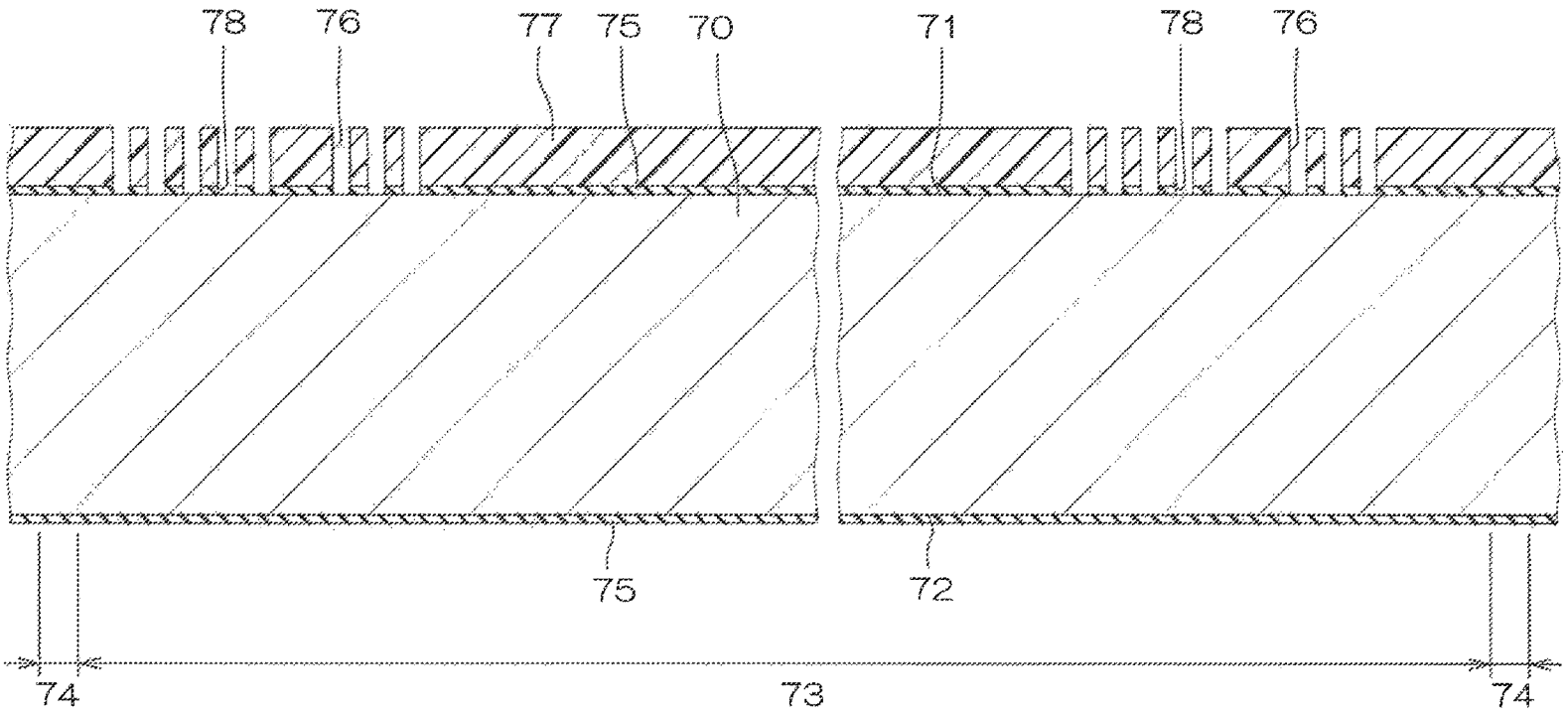

Next, referring to FIG. 6C, a mask 77 having a predetermined pattern is formed on the insulating film 75 at the first main surface 71 side of the wafer 70. The mask 77 has an opening 76 of a spiral-shape in the plan view that exposes a region where the trench 30 is to be formed.

Next, an unnecessary portion of the insulating film 75 is removed by an etching method via the mask 77. The etching method may be an anisotropic etching method (e.g. a reactive ion etching method). An opening 78 of a spiral-shape in the plan view that matches the opening 76 of the mask 77 is formed in the insulating film 75. The mask 77 is removed thereafter.

Figure 6D:
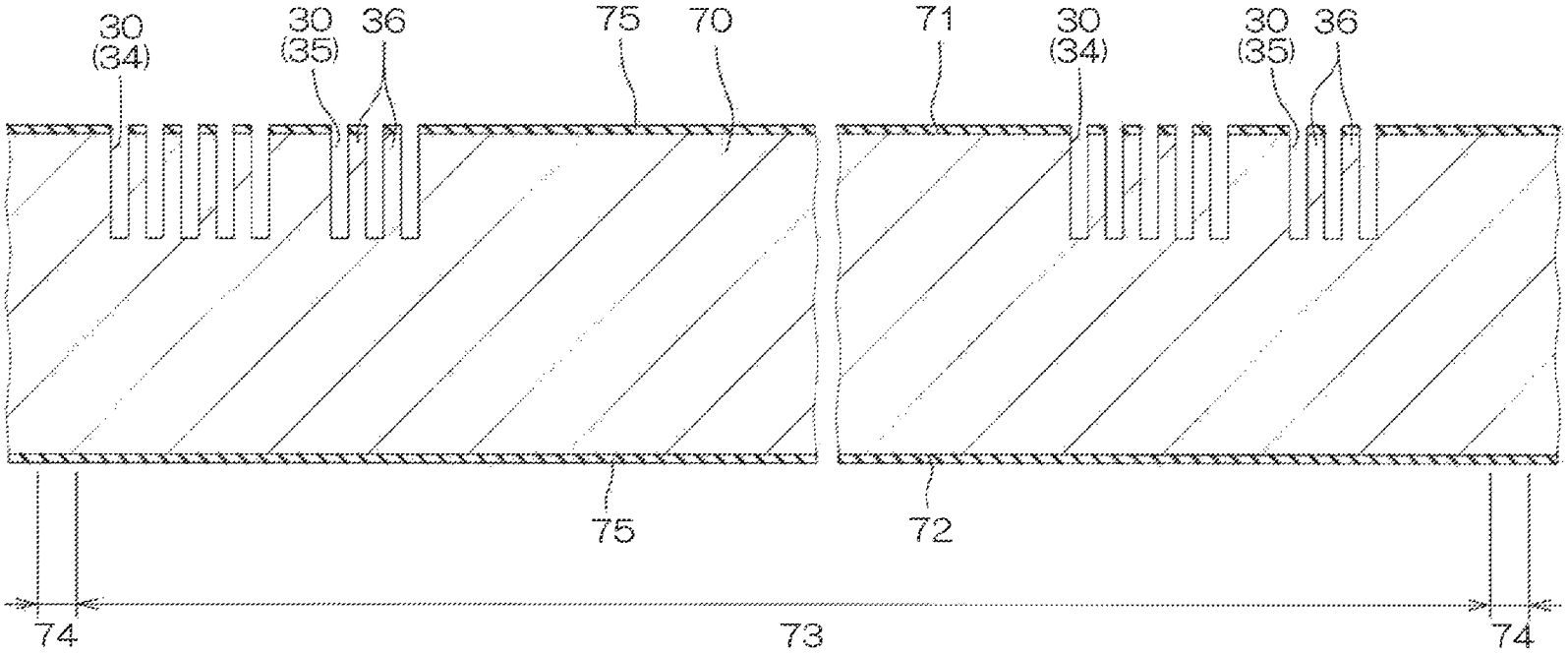

Next, referring to FIG. 6D, an unnecessary portion of the wafer 70 is removed by an etching method via the insulating film 75 as a mask. The etching method may be an anisotropic etching method (e.g. a reactive ion Etching method).

The wafer 70 is dug down toward the second main surface 72 from the first main surface 71. The trench 30 of the spiral-shape in plane view that matches the opening 78 of the insulating film 75 is thereby formed at the first main surface 71 of the wafer 70.

In this step, the trench 30 including the spiral trench 34 for the spiral portion 23, the end trench 35 for the inner end portion 21 and the end trench 35 for the outer end portion 22 is formed.

In this step, the plurality of pillar portions 36 is also formed in the end trench 35 for the inner end portion 21. The plurality of pillar portions 36 is formed in the matrix pattern in the plan view. Therefore, the end trench 35 for the inner end portion 21 is formed in the lattice shape in the plan view.

In this step, the plurality of pillar portions 36 is also formed in the end trench 35 for the outer end portion 22. The plurality of pillar portions 36 is formed in the matrix pattern in the plan view. Therefore, the end trench 35 for the outer end portion 22 is formed in the lattice shape in the plan view.

Figure 6E:
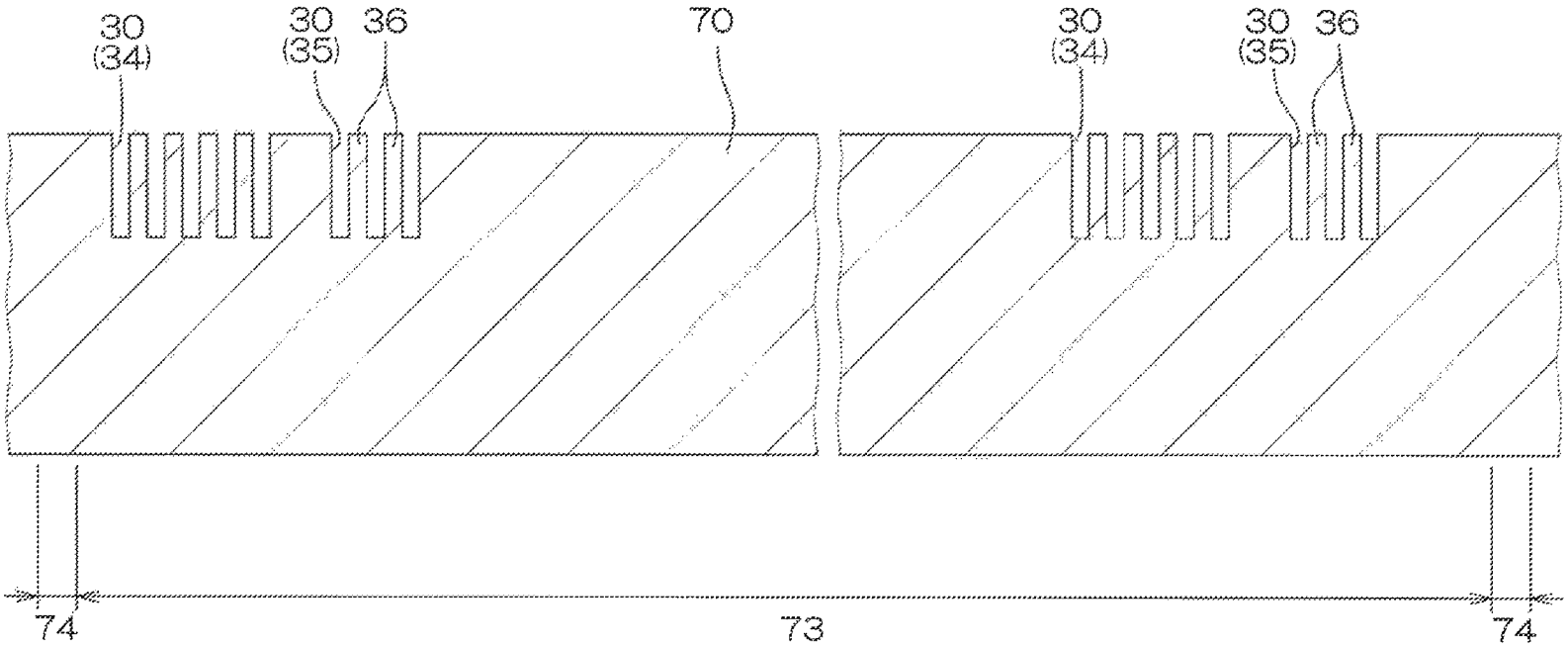

Next, referring to FIG. 6E, the insulating film 75 is removed. The insulating film 75 may be removed by an etching method. The etching method may be an isotropic etching method (e.g. a wet etching method).

Figure 6F:
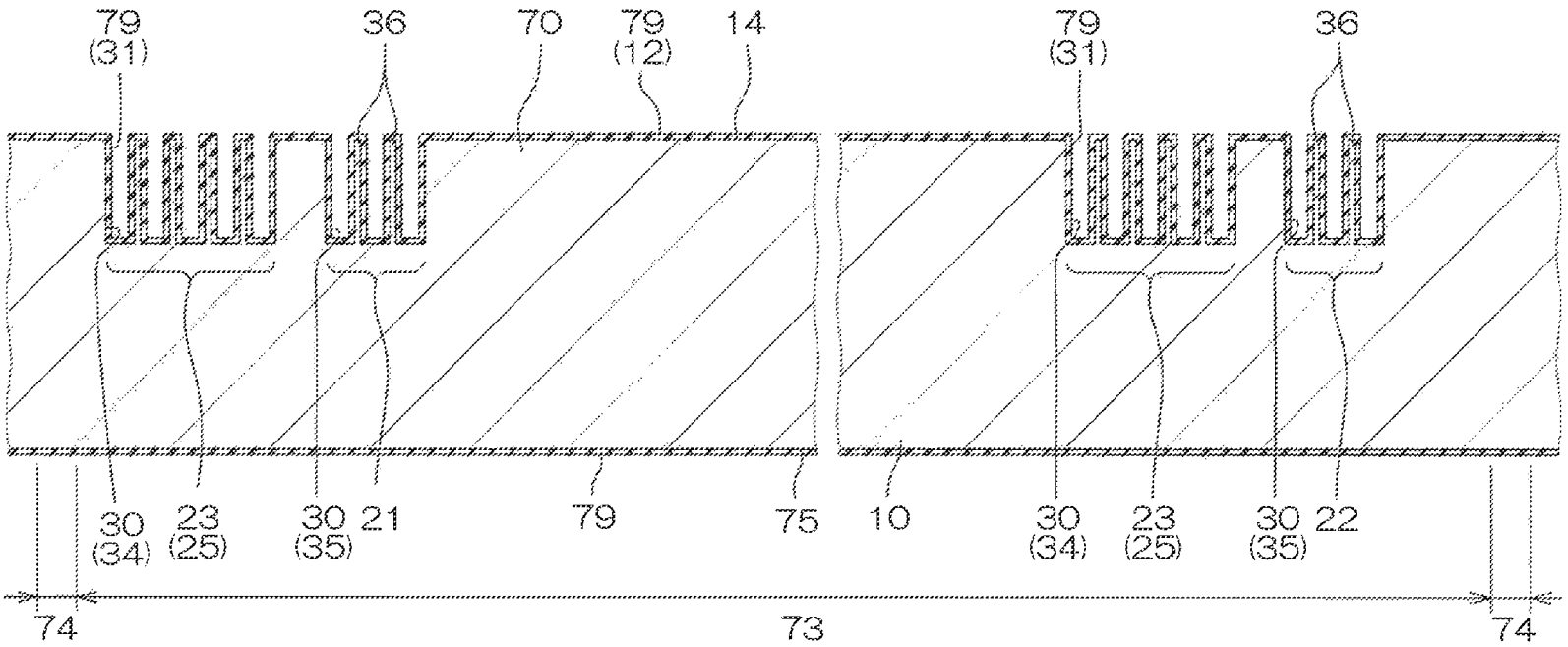

Next, referring to FIG. 6F, another insulating film 79 is formed on the first main surface 71 and the second main surface 72 of the wafer 70. The insulating film 79 may be a silicon oxide film. The insulating film 79 may be formed by a CVD method. The insulating film 79 may be formed by a thermal oxidation treatment.

A thickness of the insulating film 79 formed on the first main surface 71 is substantially equal to a thickness of the insulating film 79 formed on the second main surface 72. Therefore, a stress generated at the first main surface 71 side and a stress generated at the second main surface 72 side become substantially equal. The warping of the wafer 70 can thus be suppressed.

The surface insulating film 12 is formed by a portion covering the first main surface 71 of the wafer 70 in the insulating film 79 formed on the first main surface 71 side of the wafer 70. The inner wall insulating film 31 is formed by a portion covering the inner wall surface of the trench 30 in the insulating film 79 formed on the first main surface 71 side of the wafer 70. In this step, the surface insulating film 12 and the inner wall insulating film 31 are formed so that thicknesses thereof are to be substantially equal.

Figure 6G:
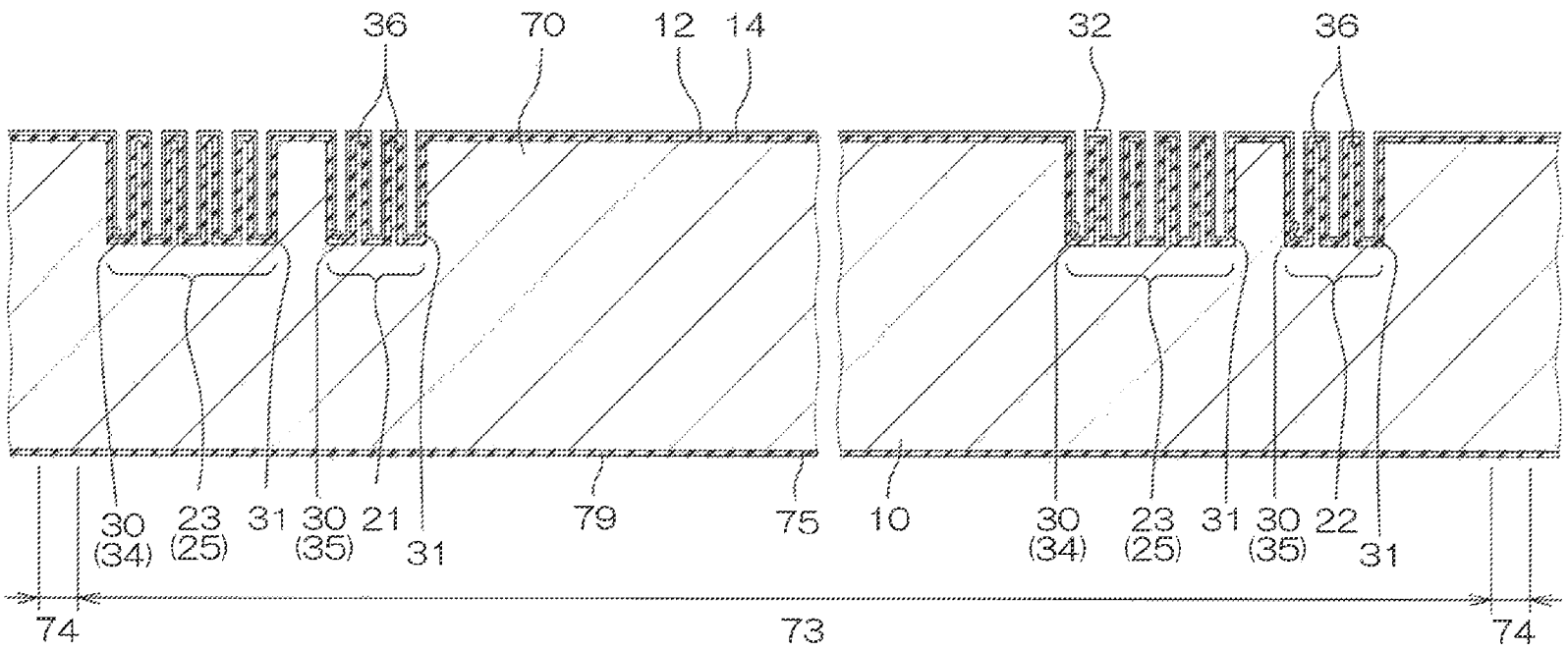

Next, referring to FIG. 6G, a titanium layer is formed on the insulating film 79 of the first main surface 71 side of the wafer 70. The titanium layer may be formed by a sputtering method. The first conductive layer 32 is formed by the titanium layer. A thickness of the first conductive layer 32 may be equal to or greater than 1000 Å and equal to or smaller than 2000 Å (e.g. approximately 1500 Å).

Figure 6H:
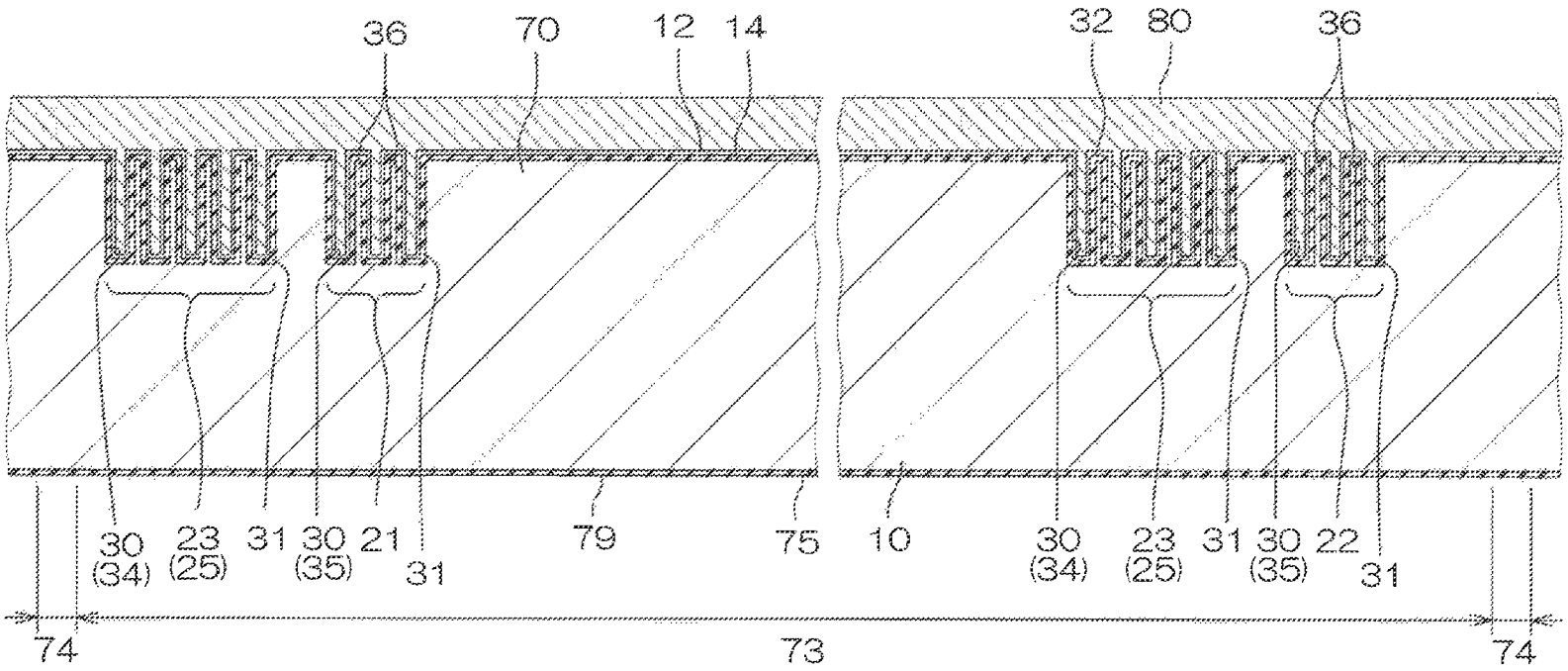

Next, referring to FIG. 6H, a copper layer 80 to be a basis of the second conductive layer 33 is formed on the first main surface 71 side of the wafer 70. The copper layer 80 is embedded in a recessed space defined by the first conductive layer 32 inside the trench 30 and covers a whole region of the first main surface 71 of the wafer 70.

Figure 6I:
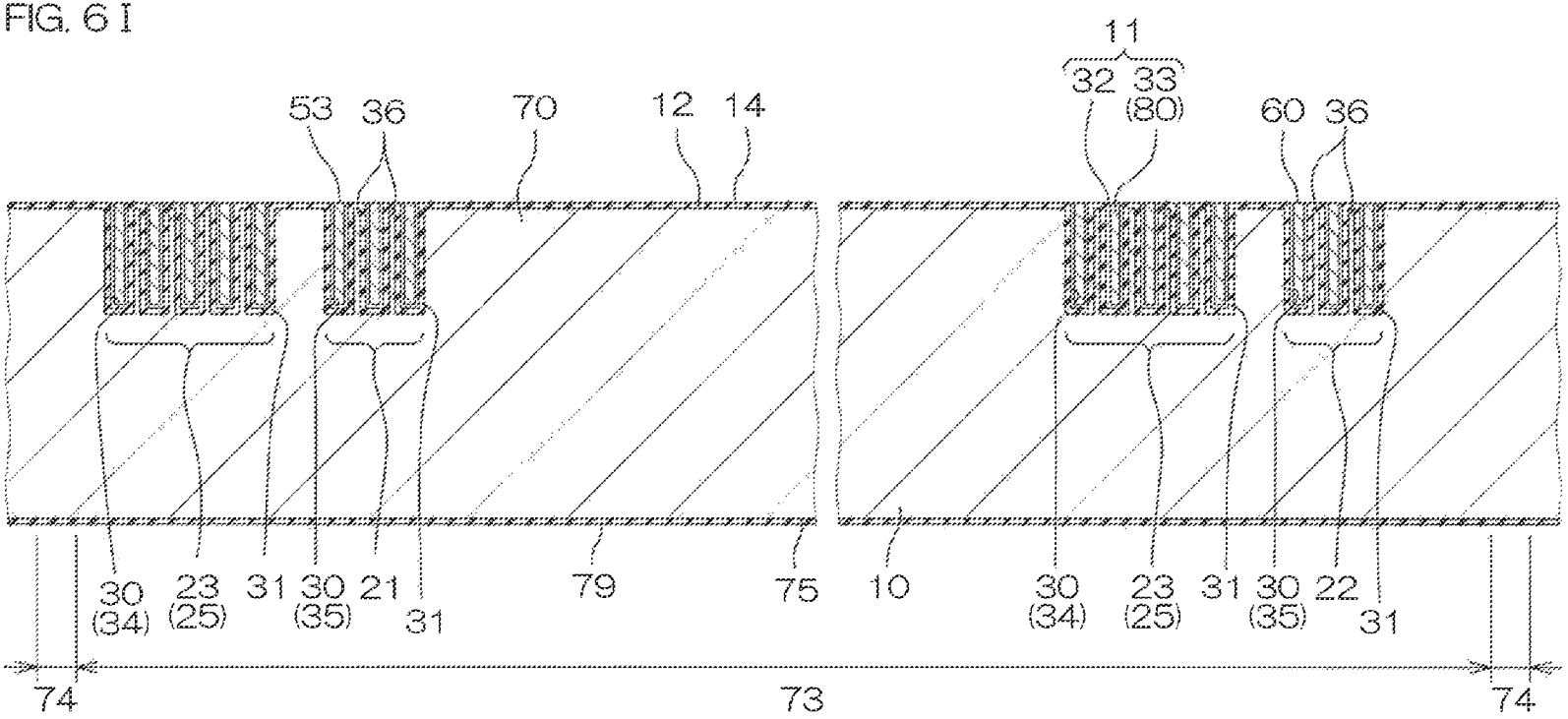

Next, referring to FIG. 6I, the copper layer 80 outside the trench 30 is selectively removed. The copper layer 80 may be removed by an etching method. The etching method may be an isotropic etching method (e.g. a wet etching method). The copper layer 80 is thereby embedded in the trench 30 via the first conductive layer 32. The second conductive layer 33 is formed by the copper layer 80 embedded in the trench 30.

Next, the first conductive layer 32 outside the trench 30 is selectively removed. The first conductive layer 32 may be removed by an etching method. The etching method may be an isotropic etching method (e.g. a wet etching method). The coil conductor 11 is thereby formed.

Figure 6J:
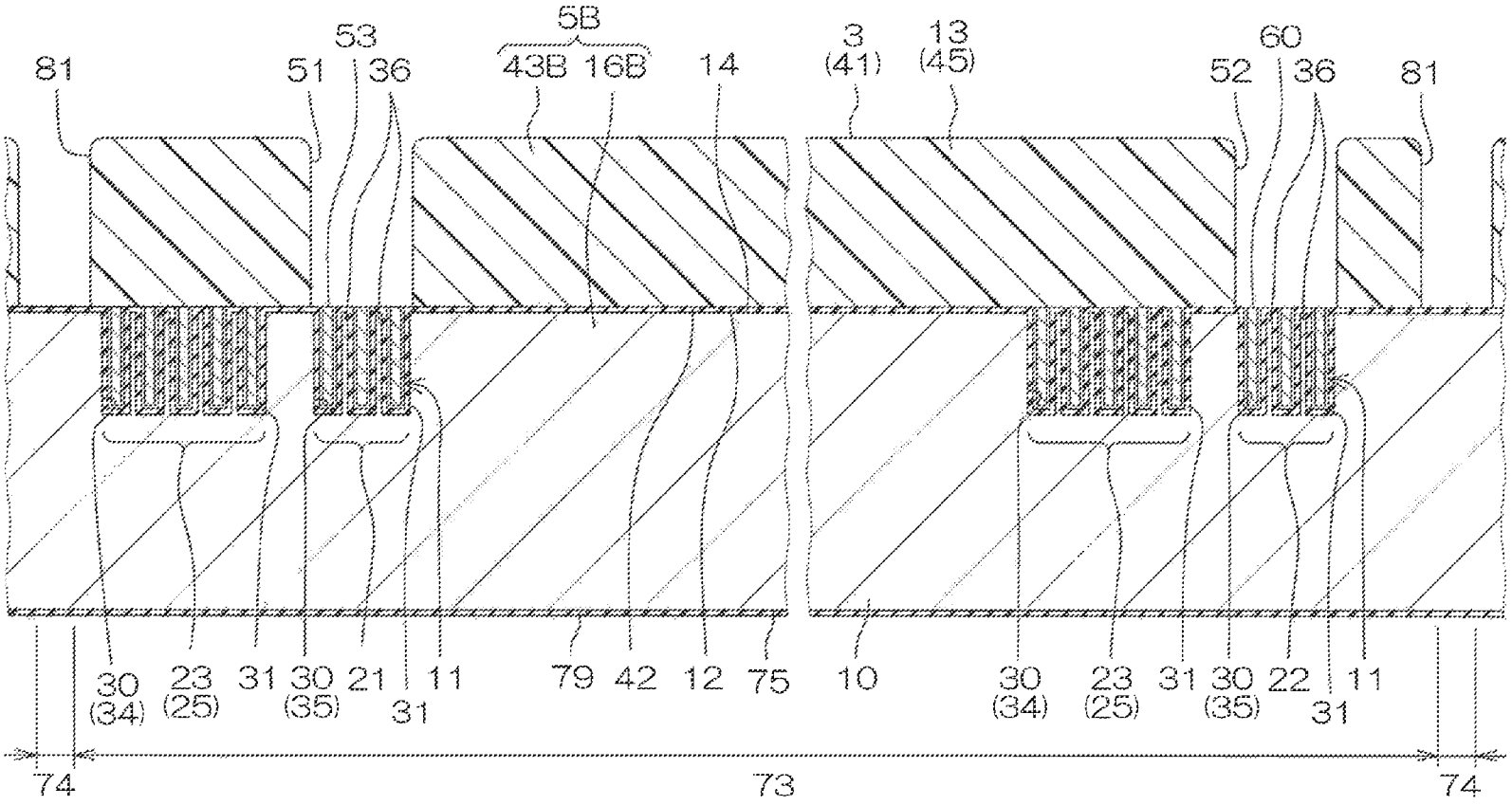

Next, referring to FIG. 6J, a photosensitive resin is applied so as to cover the entire surface of the first main surface 71 of the wafer 70. The photosensitive resin may be a photoresist of negative type including an epoxy resin. The insulating layer 13 is formed by the photosensitive resin. The thickness T of the insulating layer 13 may be equal to or greater than 10 μm and equal to or smaller than 100 μm (e.g. approximately 40 μm).

Next, the insulating layer 13 is selectively exposed via a photomask (not shown). In this step, an exposure region is set to the insulating layer 13 and the exposure region is selectively exposed. The exposure region is a region excluding a region to form the first pad opening 51, a region to form the second pad opening 52, and a region to form an opening exposing the boundary region 74 in the insulating layer 13, respectively.

Next, the insulating layer 13 is developed. The first pad opening 51, the second pad opening 52 and the opening 81 exposing the boundary region 74 are thereby formed in the insulating layer 13. A heat treatment may be performed to cure the insulating layer 13 thereafter, if necessary.

Figure 6K:
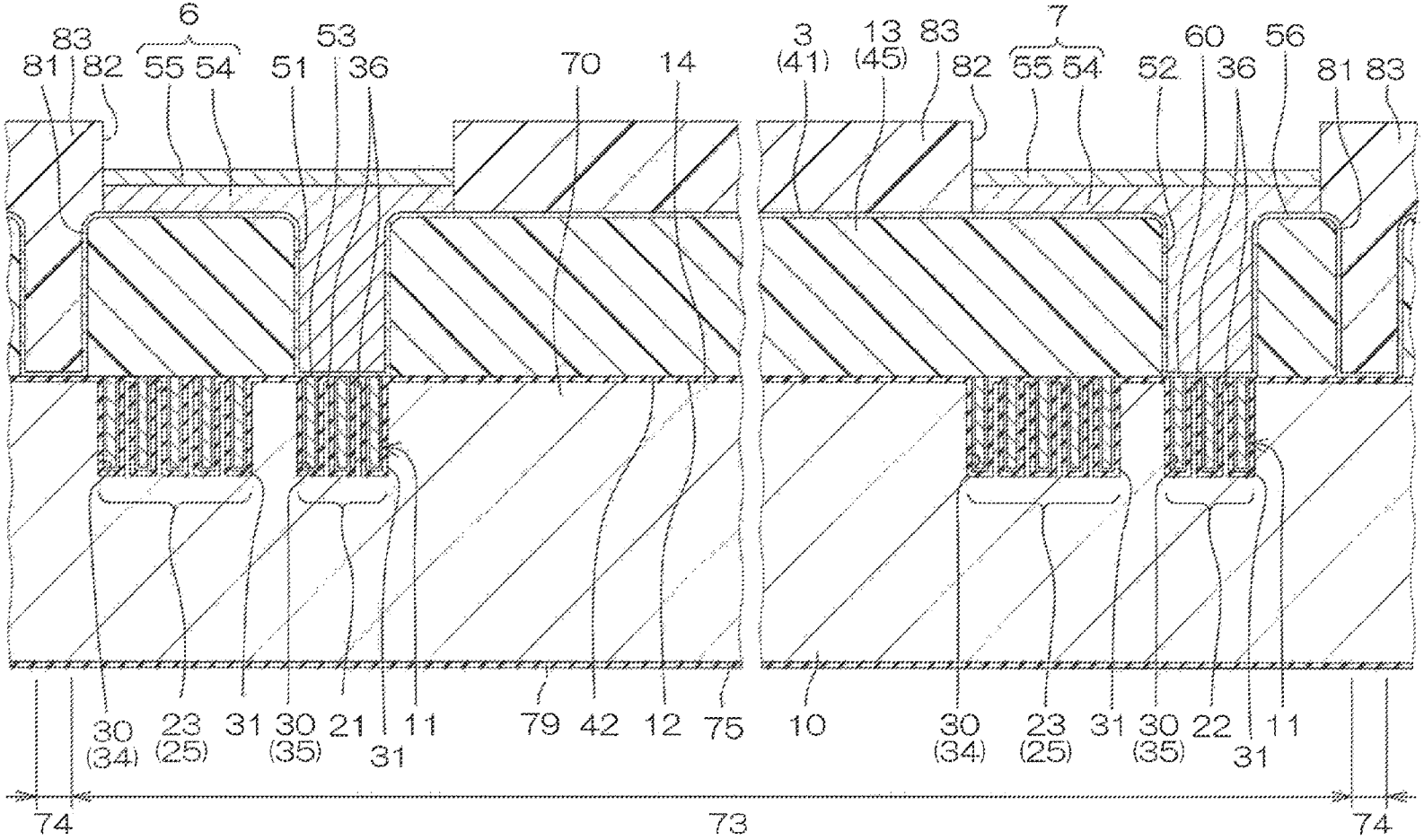

Next, referring to FIG. 6K, the first external terminal 6 and the second external terminal 7 are formed. The first external terminal 6 and the second external terminal 7 may be formed at the same time. The step of forming the first external terminal 6 and the second external terminal 7 includes a step of forming the laminated structure including the first conductive layer 54 and the second conductive layer 55.

In the step of forming the first conductive layer 54, first, the titanium layer is formed along the first main surface 41 of the insulating layer 13, the inner wall of the first pad opening 51 and the inner wall of the second pad opening 52. The titanium layer may be formed by a sputtering method. The first lower metal layer 56 is formed by the titanium layer.

Next, the copper seed layer (not shown) is formed on the first lower metal layer 56. The copper seed layer may be formed by the sputtering method.

Next, the mask 83 having the predetermined pattern is formed on the copper seed layer (not shown). The mask 83 has openings selectively exposing regions where the first upper metal layer 57 of the first external terminal 6 and the first upper metal layer 57 of the second external terminal 7 are to be formed.

Next, the copper plating layer is formed on the copper seed layer (not shown) exposed from the mask 83. The copper plating layer may be formed by the electrolytic copper plating method. The first upper metal layer 57 is formed by the copper plating layer.

In the step of forming the second conductive layer 55, first, a nickel-phosphorus alloy plating layer is formed on the first conductive layer 54 exposed from the mask 83. The nickel-phosphorus alloy plating layer may be formed by an electrolytic nickel-phosphorus alloy plating method. The second lower metal layer 58 is formed by the nickel-phosphorus alloy plating layer.

Next, a gold plating layer is formed on the second lower metal layer 58 exposed from the mask 83. The second upper metal layer 59 is formed by the gold plating layer. The mask 83 is removed thereafter.

Next, in the first lower metal layer 56 and the copper seed layer (not shown), portions that had been covered with the mask 83 is removed. The first lower metal layer 56 and the copper seed layer (not shown) may be removed by an etching method using the second upper metal layer 59 as a mask. The first external terminal 6 and the second external terminal 7 are thereby formed.

Figure 6L:
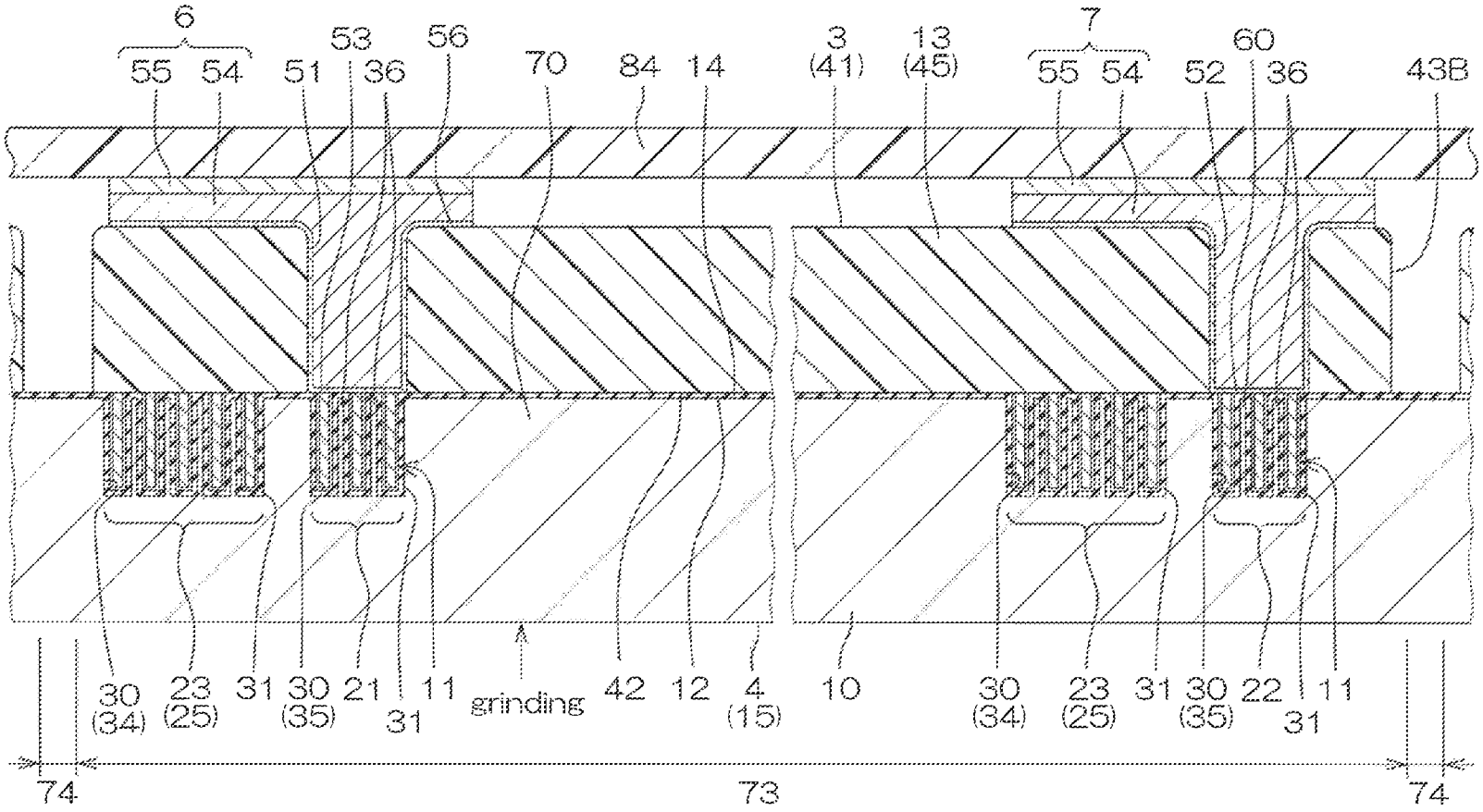

Next, referring to FIG. 6L, a support tape 84 supporting the wafer 70 is affixed to the first main surface 71 side of the wafer 70.

Next, the second main surface 72 of the wafer 70 is ground. The grinding step may include a Chemical Mechanical Polishing method (CMP method). The wafer 70 is therefore thinned. The thickness of the wafer 70 after the grinding step may be equal to or greater than 50 μm and equal to or smaller than 150 μm (e.g. approximately 100 μm).

Figure 6M:
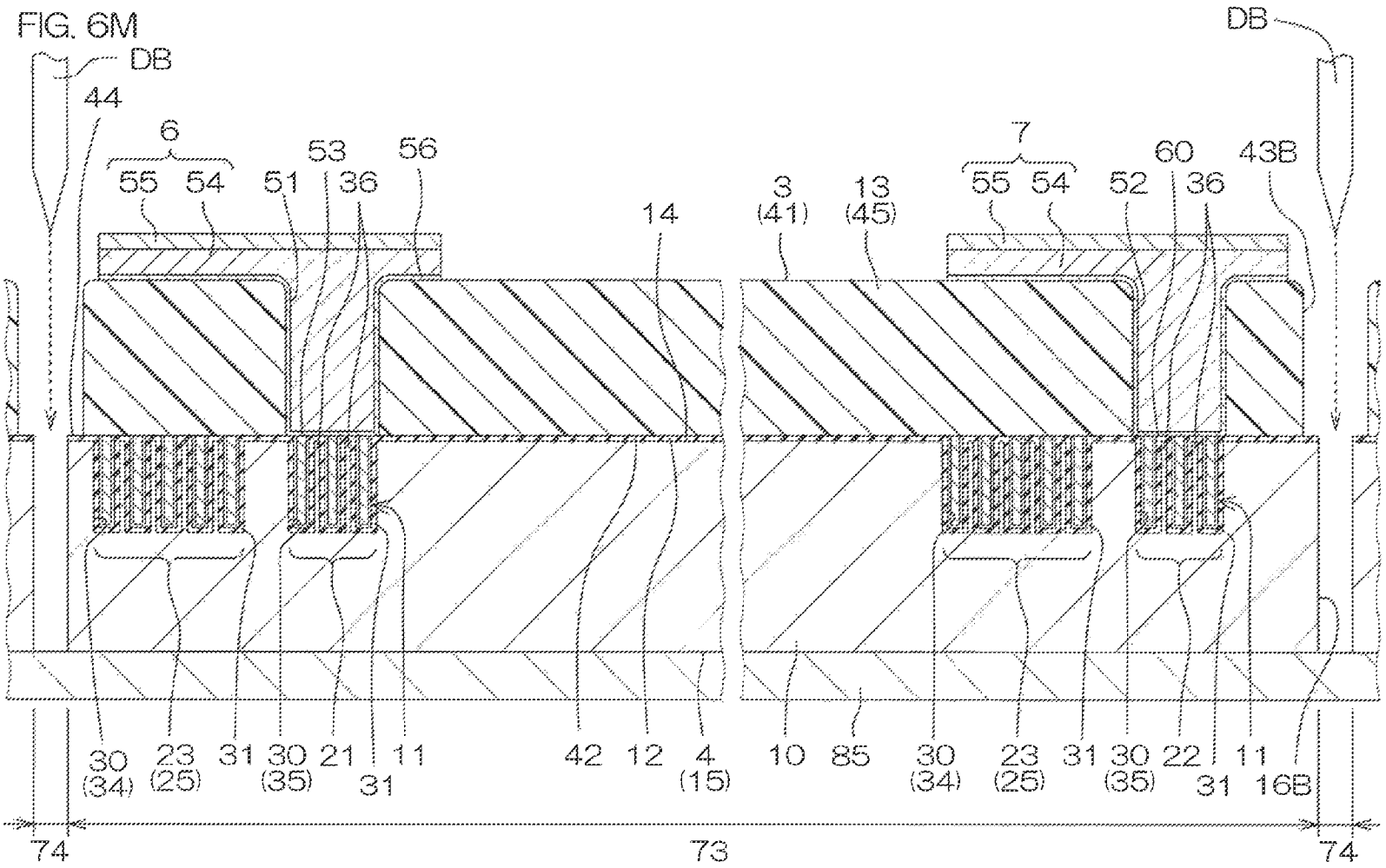

Next, referring to FIG. 6M, the support plate 85 supporting the wafer 70 is affixed to the second main surface 72 side of the wafer 70. The support tape 84 may be removed thereafter.

Next, the wafer 70 is cut along the periphery (i.e. the boundary region 74) of each chip forming region 73. The cutting step of the wafer 70 may be performed by Dicing blade DB.

The plurality of the chip inductor 1 is thus cut out from one piece of the wafer 70. The first main surface 71 of the wafer 70 becomes the first main surface 14 of the substrate 10 in the chip inductor 1. The second main surface 72 of the wafer 70 becomes the second main surface 15 of the substrate 10 in the chip inductor 1.

In the wafer 70, the cutting surface cut by the Dicing blade DB becomes the lateral surfaces 16A, 16B of the substrate 10. Through the steps including the above, the chip inductor 1 is manufactured.

Figure 7:
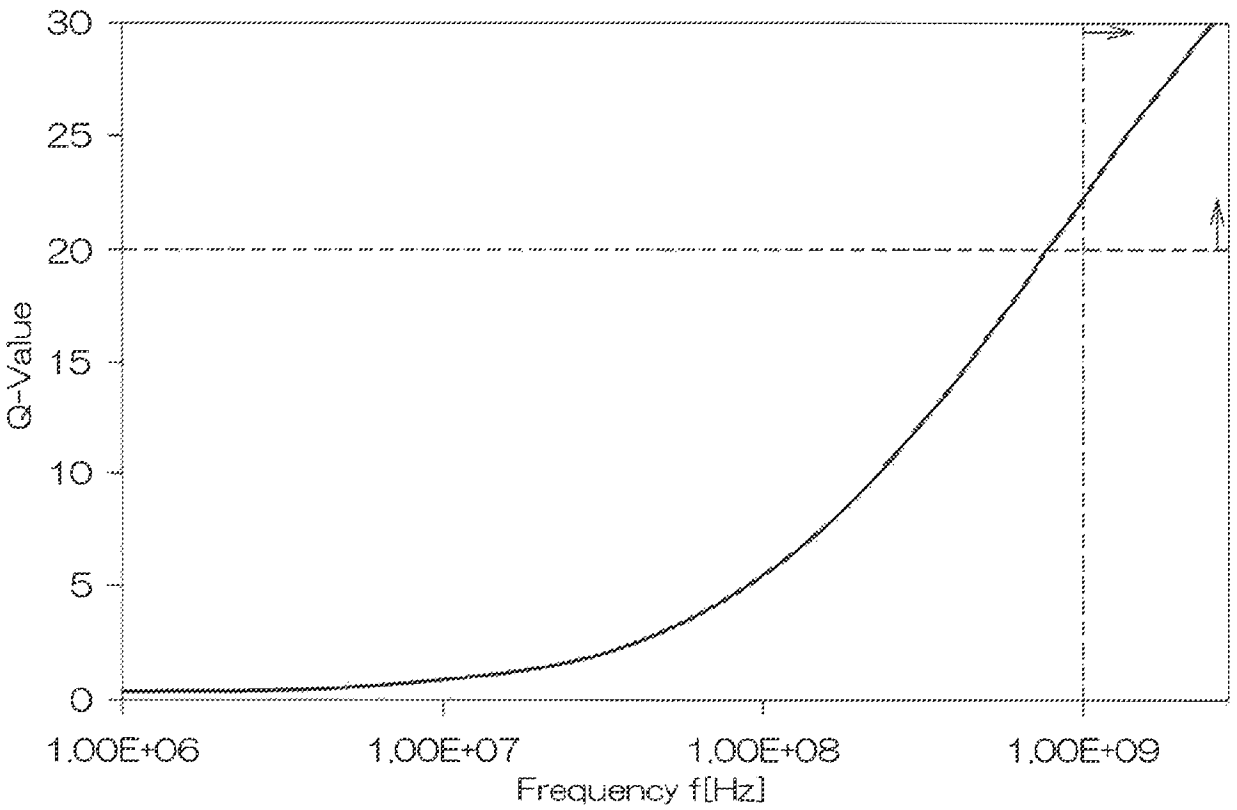
FIG. 7 is a graph showing a result of simulation of a Q-value of the chip inductor shown in FIG. 1.

FIG. 7 is a graph showing a result of simulation of a Quality Factor (Q-value) of the chip inductor 1 shown in FIG. 1. In FIG. 7, the vertical axis is Q-value and the horizontal axis is Frequency.

Here, the Q-value of the chip inductor 1 was obtained in a case where the frequency of the current flowing through the coil conductor 11 was increased from 0 Hz to 10 GHz. The inductance component of the coil conductor 11 was 3 nH.

The Q-value of the chip inductor 1 is given by "$Q=2\pi fL/R$". "f" is the frequency of the current flowing through the coil conductor 11. "L" is the inductance component of the coil conductor 11. "R" is the resistance component of the coil conductor 11. A high Q-value indicates that the inductor is close to an ideal inductor. The Q-value increases due to the increase of "L" and/or the reduction of "R".

Referring to FIG. 7, the Q-value of the chip inductor 1 was equal to or greater than 20 in the high frequency region of equal to or greater than 1 GHz. Therefore, it is understood that the chip inductor 1 has a small loss and is excellent as the high frequency inductance.

As described above, according to the chip inductor 1, the coil conductor 11 of the spiral-shape is routed to the region between the first external terminal 6 and the second external terminal 7 at the first main surface 14 of the substrate 10. Furthermore, the coil conductor 11 is routed to the first facing region facing the first external terminal 6 and the second facing region facing the second external terminal 7.

A planar area of the coil conductor 11 can thus be increased. In particular, in the chip inductor 1, the coil conductor 11 is embedded in the trench 30 having the spiral-shape and formed by digging the first main surface 14 of the substrate 10. Therefore, a sectional area of the coil conductor 11 can also be increased. The resistance component of the coil conductor 11 can thereby be reduced.

According to the chip inductor 1, the formation region of the coil conductor 11 is expanded from the region between the first external terminal 6 and the second external terminal 7 to the first facing region facing the first external terminal 6 and the second facing region facing the second external terminal 7. The number of windings of the coil conductor 11 can thus be increased. The inductance component of the coil conductor 11 can thereby be increased.

According to the chip inductor 1, the insulating layer 13 is interposed in the region between the coil conductor 11 and the first external terminal 6 and the region between the coil conductor 11 and the second external terminal 7.

The parasitic capacitance between the coil conductor 11 and the first external terminal 6 and the parasitic capacitance between the coil conductor 11 and the second external terminal 7 can thus be suppressed. As a result, the fluctuation of Q-value due to the parasitic capacitances can be suppressed. The chip inductor 1 capable of appropriately increasing the Q-value can thus be provided.

According to the chip inductor 1, the end trench 35 is formed wider than the spiral trench 34. The plurality of pillar portions 36 are formed in the end trench 35.

As a result, the apparent pad size can be increased, and the opening width W2 of the end trench 35 can be narrowed by the amount corresponding to the number of the pillar portions 36 at the same time. The decrease of the filling property (film forming property) of the coil conductor 11 with respect to the end trench 35 can thus be suppressed, in a case where the end trench 35 wider than the spiral trench 34 is formed.

In the chip inductor 1, the width W3 between adjacent ones of the pillar portions 36 is preferably set to be substantially equal to the opening width W1 of the spiral trench 34 (W3≈W1 or W3=W1).

In the chip inductor 1, the width W4 between the side wall of the end trench 35 and the plurality of pillar portions 36 is also preferably set to be substantially equal to the opening width W 1 of the spiral trench 34 (W4≈W1 or W4=W1).

The coil conductor 11 can thus be appropriately embedded in the spiral trench 34 and the end trench 35 at substantially equal speed and substantially equal rate. Therefore, the first external terminal 6 can be appropriately connected to the inner end portion 21. Also, the second external terminal 7 can be appropriately connected to the outer end portion 22.

Hereinafter, a case where the first external terminal 6 and the second external terminal 7 include a pure nickel layer instead of the second lower metal layer 58 respectively shall now be considered. In this case, the First external terminal 6 and the second external terminal 7 may be affected by a magnetic field from the coil conductor 11 since the pure nickel layer is made of a ferromagnetic material.

When the first external terminal 6 and the second external terminal 7 are affected by the magnetic field, eddy currents may be generated at the first external terminal 6 and the second external terminal 7 due to the electromagnetic induction effect. Due to the eddy current, the current flowing through the coil conductor 11 may vary. As a result, noise may be generated between the first external terminal 6 and the second external terminal 7.

Therefore, in the chip inductor 1, the first external terminal 6 and the second external terminal 7 each having the second lower metal layer 58 including the nickel-phosphorus alloy are formed. The nickel-phosphorus alloy is a nonmagnetic material or has a property similar to a nonmagnetic material.

The magnetization of the first external terminal 6 and the second external terminal 7 can thus be suppressed. As a result, generation of eddy currents at the first external terminal 6 and the second external terminal 7 can be suppressed. Generation of noise between the first external terminal 6 and the second external terminal 7 can thus be suppressed. Corrosion of the first conductive layer 54 can also be suppressed by the second conductive layer 55 including a nickel-phosphorus alloy.

Of course, when the noise is small, the second conductive layer 55 having the nickel layer free from phosphorus may be adopted instead of the nickel-phosphorus alloy layer.

According to the chip inductor 1, the insulating layer 13 has a single layer structure consisting of the resin layer 45. This resin layer 45 is made of the photosensitive resin. The photosensitive resin is made of the negative type photoresist containing the epoxy resin.

The first pad opening 51 and the second pad opening 52 can thus be formed by exposure and development. The first pad opening 51 and the second pad opening 52 are not formed by the etching method.

Undesired damage caused by the etching method can thereby be prevented in the coil conductor 11 (the inner end portion 21 and the outer end portion 22). The fluctuations of the Q-value of the coil conductor 11 due to such damage can thereby be prevented.

Figure 8:
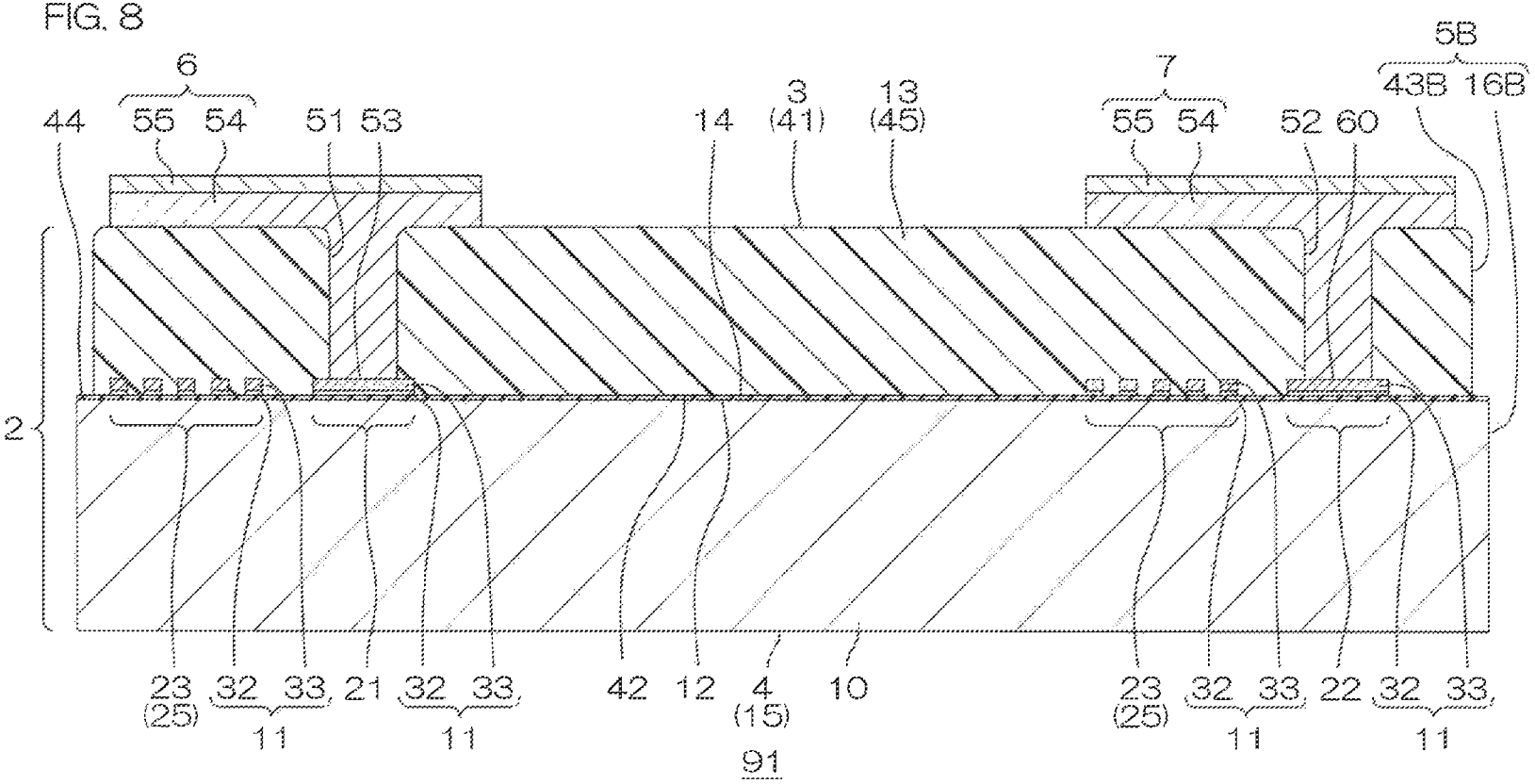
FIG. 8 is a cross-sectional view of a chip inductor according to a second preferred embodiment of the present invention.

FIG. 8 is a cross-sectional view of a chip inductor 91 according to a second preferred embodiment of the present invention. Hereinafter, the same reference numerals are applied to the same structures as those described for the chip inductor 1 and the description thereof will be omitted.

Referring to FIG. 8, the trench 30 is not formed at the first main surface 14 of the substrate 10 in the chip inductor 91. The coil conductor 11 is formed in a film-like on the first main surface 14 (on the surface insulating film 12).

FIG. 9A to FIG. 9D are cross-sectional views for explaining an example of a manufacturing method of the chip inductor 91 shown in FIG. 8. Hereinafter, only different points from the manufacturing method of the chip inductor 1 will be explained.

Figure 9A:
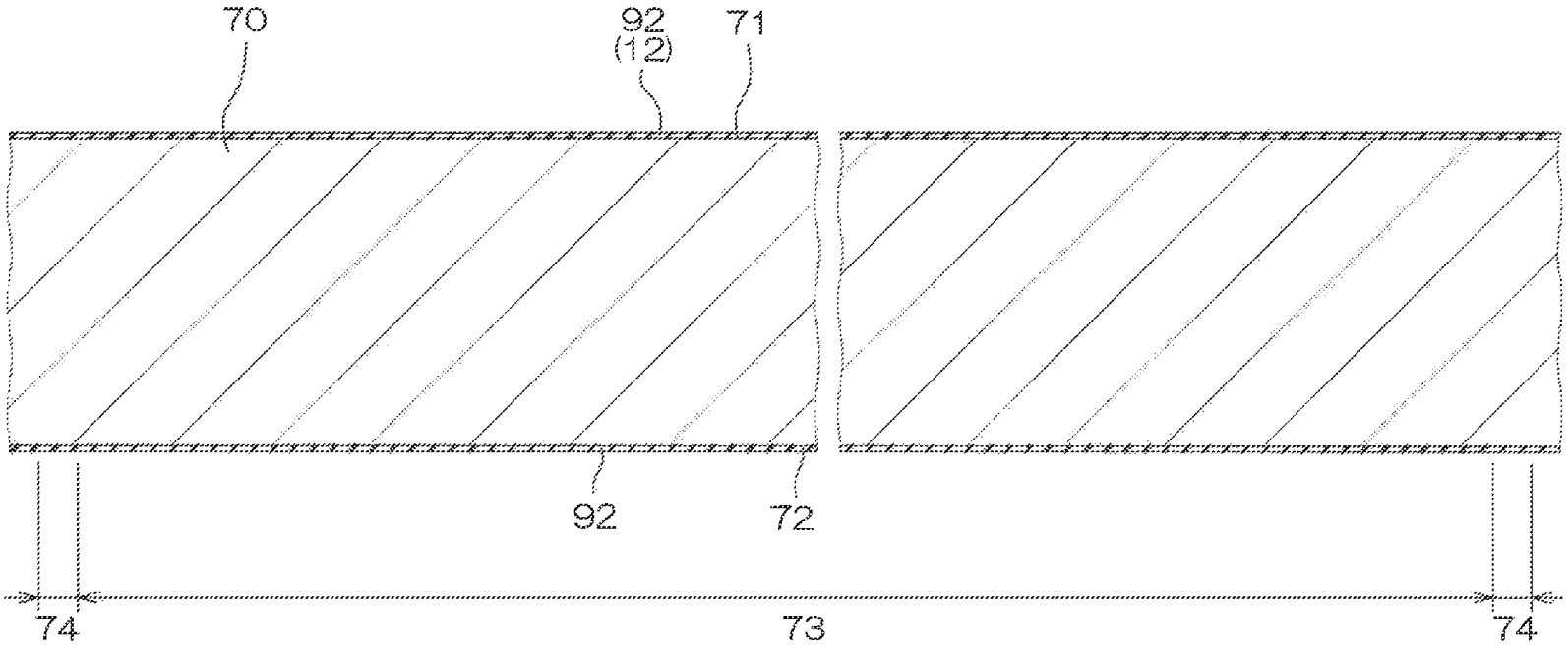
FIG. 9A to FIG. 9D are cross-sectional views for explaining an example of a manufacturing method of the chip inductor shown in FIG. 8.

Referring to FIG. 9A, first, the insulating film 92 is formed on the first main surface 71 and the second main surface 72 of the wafer 70, respectively.

The insulating film 92 may be formed by a CVD method. The insulating film 92 may be formed by a thermal oxidation treatment. The insulating film 92 may be a silicon oxide film. The insulating film 79 formed on the first main surface 71 side of the wafer 70 becomes the surface insulating film 12.

A thickness of the insulating film 92 formed on the first main surface 71 is substantially equal to a thickness of the insulating film 92 formed on the second main surface 72. Therefore, the stress generated at the first main surface 71 side and the stress generated at the second main surface 72 side of the wafer 70 become substantially equal. The warping of the wafer 70 can thus be suppressed.

Figure 9B:
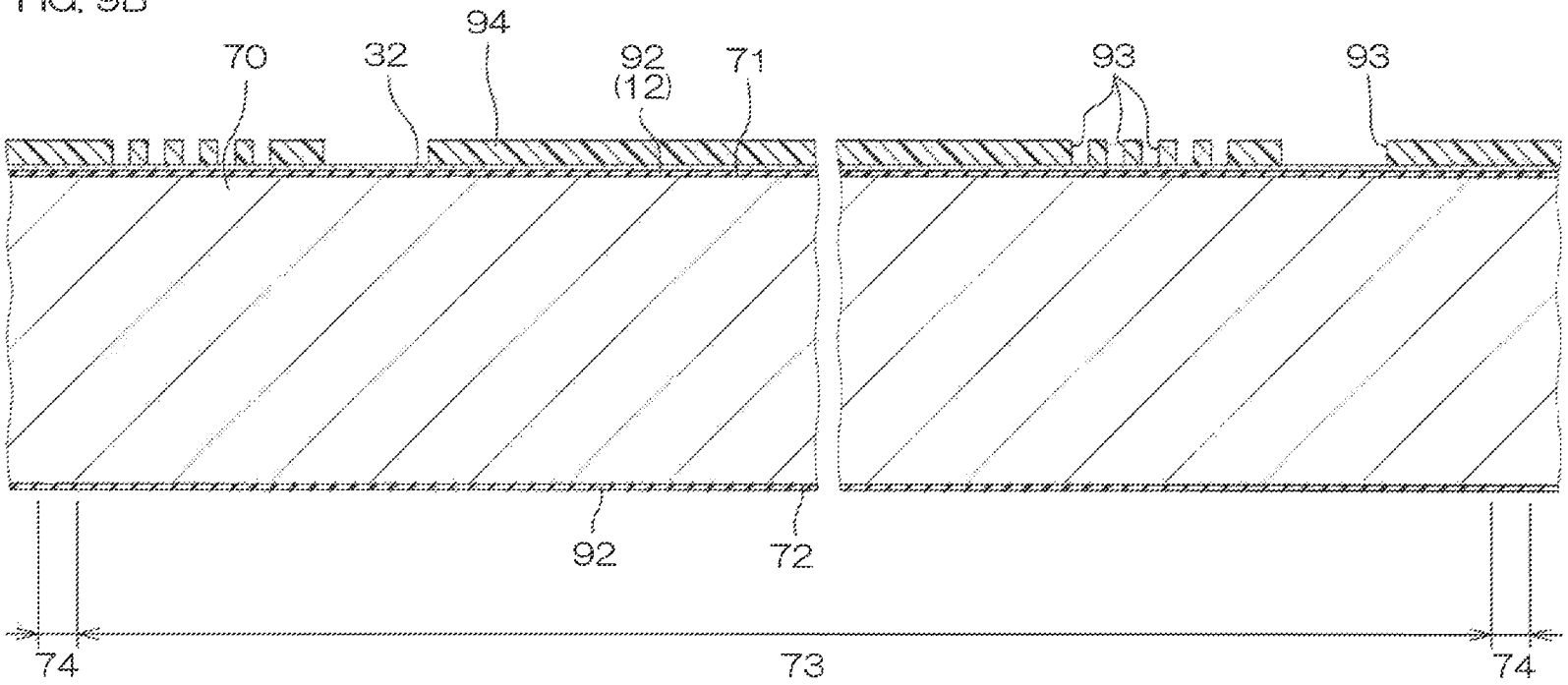

Next, referring to FIG. 9B, the titanium layer is formed on the surface insulating film 12. The titanium layer may be formed by a sputtering method. The first conductive layer 32 is formed by the titanium layer.

Next, the copper seed layer (not shown) is formed on the first conductive layer 32. The copper seed layer may be formed by a sputtering method.

Next, the mask 94 having a predetermined pattern is formed on the copper seed layer (not shown). The mask 94 has an opening 93 of a spiral-shape that exposes a region to form the second conductive layer 33 of the coil conductor 11 in the first conductive layer 32.

Figure 9C:
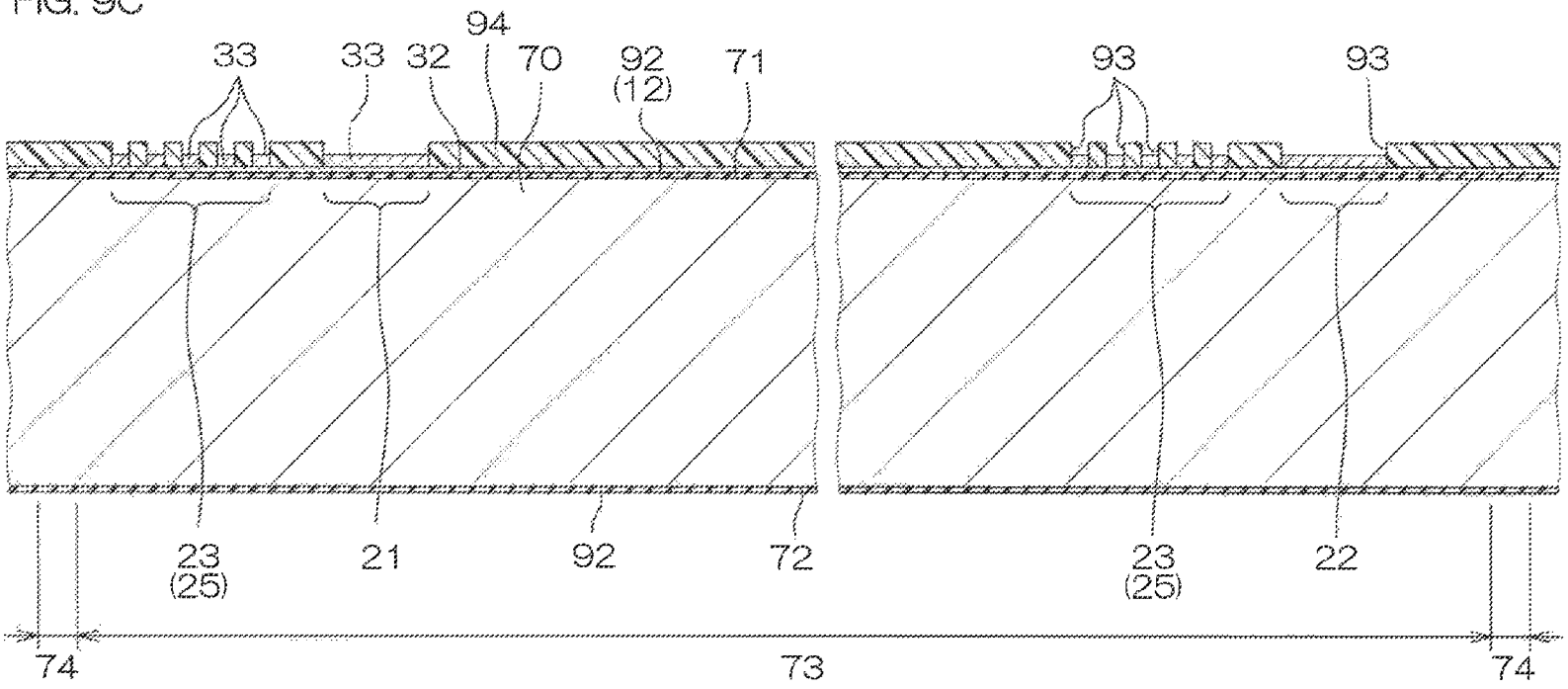

Next, referring to FIG. 9C, the copper plating layer is formed on the first conductive layer 32 exposed from the mask 94. The copper plating layer may be formed by an electrolytic copper plating method. The second conductive layer 33 matching the opening 93 of the mask 94 is formed by the copper plating layer. The mask 94 is removed thereafter.

Figure 9D:
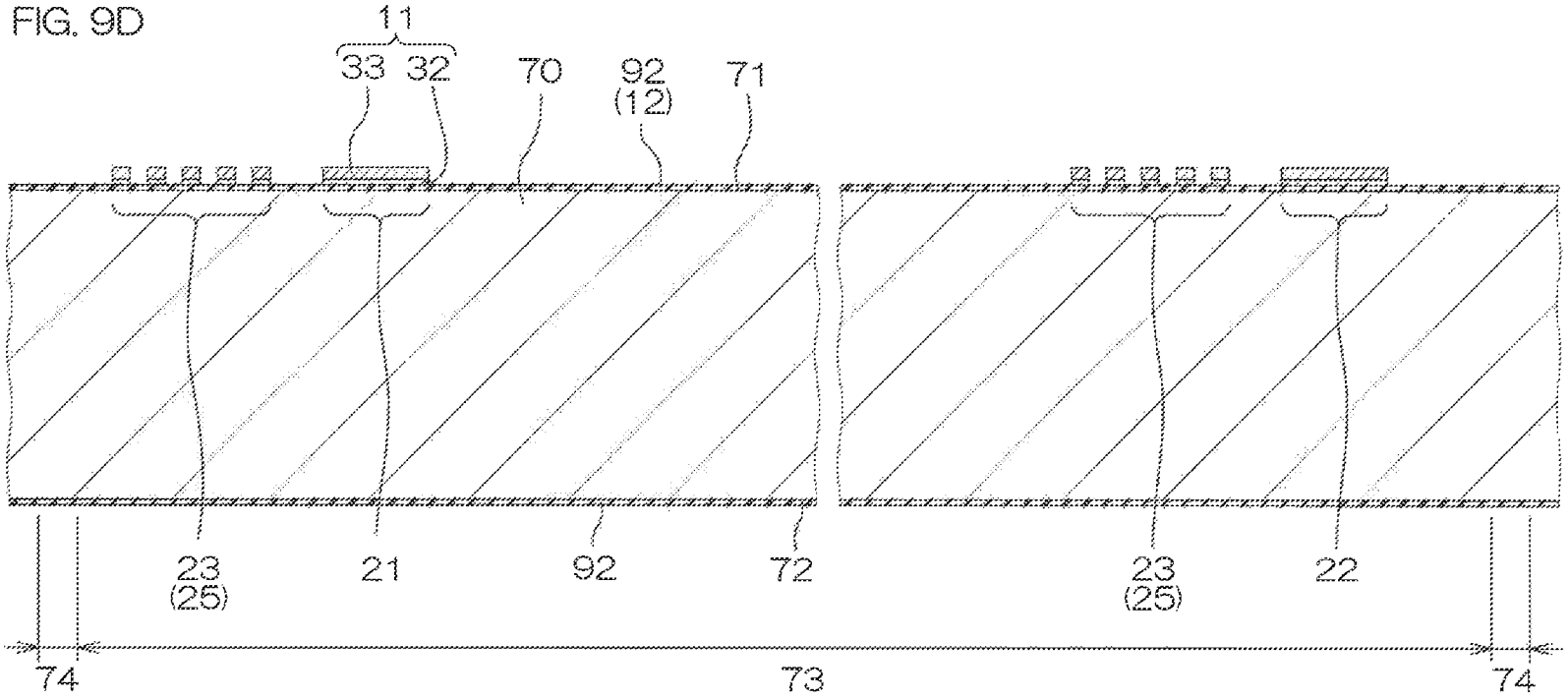

Next, referring to FIG. 9D, in the first conductive layer 32 and the copper seed layer (not shown), portions that had been covered with the mask 94 are removed. The first conductive layer 32 and the copper seed layer (not shown) are removed by an etching method using the second conductive layer 33 as a mask. The etching method may be an isotropic etching method (e.g. a wet etching method).

The coil conductor 11 of the film-like is thereby formed. Thereafter, the chip inductor 91 is manufactured through substantially the same steps as the steps described in FIG. 6J to FIG. 6M.

As described above, according to the chip inductor 91, substantially equal effects as those of the chip inductor 1 can be achieved, although the cross-sectional area of the coil conductor 11 can not be increased as much as the chip inductor 1. According to the chip inductor 91, since the trench 30 is not formed, the cost can be reduced by reducing the number of steps.

Figure 10:
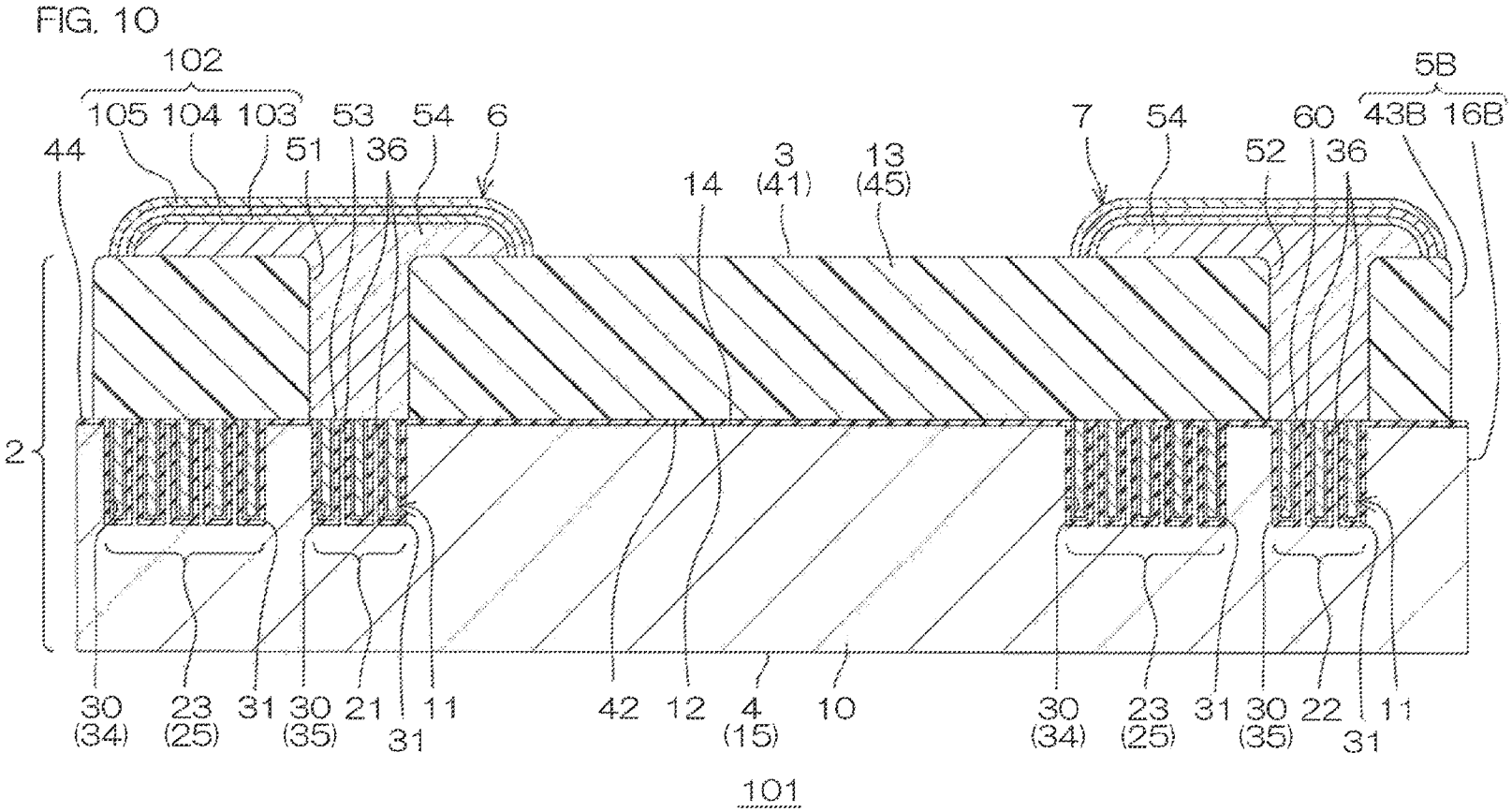
FIG. 10 is a cross-sectional view of a chip inductor according to a third preferred embodiment of the present invention.

FIG. 10 is a cross-sectional view of a chip inductor 101 according to a third preferred embodiment of the present invention. Hereinafter, the same reference numerals are applied to the same structures as those described for the chip inductor 1 and the description thereof will be omitted.

Referring to FIG. 10, the first external terminal 6 and the second external terminal 7 include a second conductive layer 102 instead of the second conductive layer 55, respectively. Each second conductive layer 102 covers the outer surface of each first conductive layer 54. Each second conductive layer 102 may be in contact with the first main surface 41 of the insulating layer 13.

More specifically, each second conductive layer 102 has a Ni/Pd/Au laminated structure including a nickel layer 103, a palladium layer 104, and a gold layer 105 laminated in this order from the side of the first conductive layer 54. The nickel layer 103, the palladium layer 104 and the gold layer 105 are in contact with the first main surface 41 of the insulating layer 13, respectively.

Each second conductive layer 102 may include the second lower metal layer 58 including a nickel-phosphorus alloy, instead of or in addition to the nickel layer 103, likewise the second conductive layer 55.

The second conductive layer 102 can be formed through the following steps.

First, the mask 83 is removed after the first conductive layer 54 is formed in the step of FIG. 6K. Next, in the first lower metal layer 56 and the copper seed layer (not shown), portions that had been covered with the mask 83 are removed.

Next, a nickel layer 103, a palladium layer 104, and a gold layer 105 are formed in this order so as to cover the outer surface of the first conductive layer 54. The nickel layer 103, the palladium layer 104 and the gold layer 105 may be formed by an electroless plating method, respectively. The second conductive layer 102 is thereby formed.

The second conductive layer 102 can also be formed through the following steps.

First, in the step of FIG. 6K described above, the nickel layer 103, the palladium layer 104 and the gold layer 105 are formed in this order from the side of the first conductive layer 54 by using the mask 83. The nickel layer 103, the palladium layer 104 and the gold layer 105 may be formed by an electroless plating method, respectively.

In this step, the nickel layer 103, the palladium layer 104, and the gold layer 105 are formed at intervals from the insulating layer 13, respectively. The mask 83 is removed thereafter. Next, in the first lower metal layer 56 and the copper seed layer (not shown), portions that had been covered with the mask 83 are removed. The second conductive layer 102 is thereby formed.

The second conductive layer 102 can also be formed through the following steps.

First, in the step of FIG. 6K described above, the first conductive layer 54 having substantially equal planar shape to the planar shape of the first external terminal 6 and the second external terminal 7 is formed.

Next, the nickel layer 103, the palladium layer 104 and the gold layer 105 are formed in this order from the side of the first conductive layer 54. The nickel layer 103, the palladium layer 104 and the gold layer 105 may be formed by an electroless plating method, respectively. The second conductive layer 102 is thereby formed.

As described above, according to the chip inductor 101, substantially equal effects as those of the chip inductor 1 can be achieved. The structure in which the first external terminal 6 and the second external terminal 7 include the second conductive layer 102 can also be applied to the second embodiment.

Although the embodiments of the present invention have been described above, the present invention can be implemented in still other modes.

In each of the above-described embodiments, the substrate 10 may be the semiconductor substrate made of silicon. The substrate 10 may be the semiconductor substrate made of silicon free from impurities. In a case where the substrate 10 is made of silicon, the surface insulating film 12 made of a silicon oxide film and the inner wall insulating film 31 made of a silicon oxide film can be formed by a thermal oxidation treatment.

In each of the above-described embodiments, the substrate 10 may be an insulating substrate including an inorganic insulating material or an insulating substrate including an organic insulating material. The inorganic insulating materials may include glass, ceramics, or the like. The organic insulating material may include epoxy resin, polyimide resin, or the like.

The present application corresponds to Japanese Patent Application No. 2016-182094 filed on Sep. 16, 2016, at the Japan Patent Office, and the entire disclosure of the application is incorporated herein by reference.

Although the preferred embodiments of the present invention have been described in detail, these preferred embodiments are merely concrete examples used to clarify the technical contents of the present invention, and the present invention should not be understood by being limited to these concrete examples, and the scope of the present invention is limited solely by the appended claims.

What is claimed is:

1. A chip inductor comprising:

a substrate having a main surface;

an insulating layer covering the main surface of the substrate;

an external terminal formed on the insulating layer; and a coil conductor of a spiral-shape routed to a region outside the external terminal and a region facing the external terminal at the main surface of the substrate, wherein the coil conductors is embedded in a trench of a spiral-shape that is formed at the main surface of the substrate, wherein the trench has an end trench portion and a spiral trench portion, the end trench portion being at an end of the spiral trench portion, and wherein the end trench portion has an opening width W2 larger than an opening width W1 of the spiral trench portion.

2. The chip inductor according to claim 1, wherein the external terminal penetrates the insulating layer from a surface of the insulating layer and is connected to a part of the coil conductor.

3. The chip inductor according to claim 1, wherein the insulating layer has a single layer structure consisting of a resin layer.

4. The chip inductor according to claim 1, wherein the insulating layer has a thickness of equal to or greater than 10 um.

5. The chip inductor according to claim 1, wherein the external terminal includes a first conductive layer containing copper as a main component and a second conductive layer covering the first conductive layer and containing nickel-phosphorus alloy.

6. The chip inductor according to claim 1 further comprising:

an inner wall insulating film interposed in a region between the coil conductor and an inner wall of the trench.

7. The chip inductor according to claim 1, wherein the coil conductor is formed in a film-like at the main surface of the substrate.

8. The chip inductor according to claim 1, wherein the end trench portion includes pillar portions formed by a part of the substrate.

9. The chip inductor according to claim 1, wherein the coil conductor has a laminated structure including a first conductive layer and a second conductive layer laminated in this order from an inner wall surface side of the trench.

10. The chip inductor according to claim 1, wherein the external terminal includes a first external terminal and a second external terminal formed at intervals each other, and the coil conductor includes an inner end portion formed in a first facing region facing the first external terminal and an outer end portion formed in a second facing region facing the second external terminal.

11. The chip inductor according to claim 10, wherein the first external terminal penetrates the insulating layer from a surface of the insulating layer and is connected to the inner end portion of the coil conductor, and the second external terminal penetrates the insulating layer from the surface of the insulating layer and is connected to the outer end portion of the coil conductor.

12. A chip inductor comprising:

a substrate having a main surface;

an insulating layer covering the main surface of the substrate;

a first external terminal and a second external terminal formed on the insulating layer at intervals each other; and a coil conductor of a spiral-shape routed to a region between the first external terminal and the second external terminal, a first region facing the first external terminal and a second region facing the second external terminal at the main surface of the substrate, wherein the coil conductor is embedded in a trench of a spiral-shape that is formed at the main surface of the substrate, wherein the trench has two end trench portions and spiral trench portion, the two end trench portions being at two ends of the spiral trench portion, and wherein the end trench portions have an opening width W2 larger than an opening width W1 of the spiral trench portion, respectively.

13. The chip inductor according to claim 12, wherein the insulating layer has a single layer structure consisting of a resin layer.

14. The chip inductor according to claim 12, the first external terminal and the second external terminal respectively include a first conductive layer containing copper as a main component and a second conductive layer covering the first conductive layer and containing nickel-phosphorus alloy.

15. The chip inductor according to claim 12, wherein the coil conductor is formed in a film-like at the main surface of the substrate.

16. The chip inductor according to claim 12, wherein the end trench portions include pillar portions formed by a part of the substrate, respectively.

17. The chip inductor according to claim 12, wherein the coil conductor has a laminated structure including a first conductive layer and a second conductive layer laminated in this order from an inner wall surface side of the trench.

18. The chip inductor according to claim 12, wherein the coil conductor includes an inner end portion formed in a region directory below the first external terminal and an outer end portion formed in a region directory below the second external terminal.

19. The chip inductor according to claim 18, wherein the first external terminal penetrates the insulating layer from a surface of the insulating layer and is connected to the inner end portion of the coil conductor, and the second external terminal penetrates the insulating layer from the surface of the insulating layer and is connected to the outer end portion of the coil conductor.

* * * * *